US005581519A

United States Patent [19]

Hara et al.

[11] Patent Number: 5,581,519

[45] Date of Patent: Dec. 3, 1996

[54] ANALOG INDICATOR TYPE ELECTRONIC TIMEPIECE AND CHARGING METHOD THEREOF

[75] Inventors: Tatsuo Hara; Joji Kitahara; Yasuhiro Oshima; Hidenori Makiba, all of Suwa, Japan

[73] Assignee: Seiko Epson Corporation, Tokyo, Japan

[21] Appl. No.: 427,939

[22] Filed: Apr. 26, 1995

[30] Foreign Application Priority Data

| | | | |
|---|---|---|---|
| Apr. 27, 1994 | [JP] | Japan | 6-112272 |
| May 13, 1994 | [JP] | Japan | 6-124143 |
| Jun. 10, 1994 | [JP] | Japan | 6-129295 |
| Jun. 13, 1994 | [JP] | Japan | 6-130607 |

[51] Int. Cl.[6] ..... G04C 10/00

[52] U.S. Cl. ..... 368/64; 368/205; 368/204

[58] Field of Search ..... 368/163, 64, 179, 368/180, 183, 203, 204

[56] References Cited

U.S. PATENT DOCUMENTS

| | | | |
|---|---|---|---|
| 4,644,246 | 2/1987 | Knapen | 368/64 |

FOREIGN PATENT DOCUMENTS

| | | | |
|---|---|---|---|
| 56-107773 | 8/1981 | Japan . | |
| 58-014076 | 1/1983 | Japan . | |
| 174976 | 9/1985 | Japan | 368/203 |
| 62-240893 | 10/1987 | Japan . | |
| 6-22989 | 3/1994 | Japan . | |
| 7597/75 | 6/1976 | Switzerland . | |
| 2149942 | 6/1985 | United Kingdom . | |

*Primary Examiner*—Bernard Roskoski

*Attorney, Agent, or Firm*—Stroock & Stroock & Lavan

[57] ABSTRACT

An analog indication type electronic timepiece includes a power generation device for transforming kinetic energy produced by motions of a user into electric energy and for causing the electric energy to output from a magnetic coil as an electric charging energy; a secondary power source charged by said electric charging energy; a timepiece circuit driven by a charged energy from said secondary power source to output motor drive pulses; and a drive motor including a drive coil and a drive rotor rotatably driven when the drive coil is energized by said motor drive pulses. This analog indication type electronic timepiece further includes an anti-overcharging device forming a bypass circuit for causing said electric charging energy to bypass relative to said secondary power source when the voltage at said secondary power source reaches a predetermined level, thereby preventing the overcharging to the secondary power source; and a current limiting device for forcedly limiting the bypass current flowing through said bypass circuit when the motor drive pulses are being output from said timepiece circuit, whereby an accurate analog time indication can be made while preventing a malfunction in the drive motor during the anti-overcharging operation to the secondary power source.

33 Claims, 20 Drawing Sheets

FLUX FLOW
CURRENT FLOW
MAGNETIC CORE
80
82
84
86
88a
88b
400
90°
N
S $d_2 > d_1$

ANALOG INDICATOR TYPE ELECTRONIC TIMEPIECE AND CHARGING METHOD THEREOF

BACKGROUND OF THE INVENTION

1. Field of the Invention

The present invention relates to an analog indication type electronic timepiece and particularly to such an electronic timepiece which can use kinetic energy produced by motions of a user to generate electricity, with which a secondary power source is charged.

2. Description of the Prior Art

The conventional electronic timepieces are driven by an electric energy supplied from a cell. When the cell has been consumed, it must be replaced by a new cell. To avoid such a troublesomeness, an electronic watch including an automated winding generator which is responsive to normal motions of a user's arm for generating an electric energy required to drive the watch has been developed. Attention is now attracted to such a type of electronic timepieces from the viewpoint of reduction of the resources and environmental protection since they do not produce wastes including used cells, in addition to elimination of the troublesome replacement of cells.

Such electronic timepieces comprise an internal power generator for converting a kinetic energy from motions of a user into electric energy which is in turn output from a power generating coil as a charging voltage. The charging voltage is used to charge a secondary power source from which a charged energy is supplied to a timepiece circuit.

If such an electronic timepiece is used to make an analog display, it includes a drive-motor for driving analog indicators, the drive motor being disposed within the case in which the power generator is also contained. This may cause a problem in that the drive motor fails to operate due to magnetic flux produced by the power generating coil of the power generator.

More particularly, watches or the like are frequently constructed such that the power generator is disposed adjacent the drive motor to mount various components within a small case more efficiently. As a relatively large current flows through the power generating coil, part of the magnetic flux thus produced becomes leakage flux which may adversely affect the drive motor, resulting in malfunction of its drive rotor.

Such a problem remarkably appears when a bypass circuit is formed between the power generating coil and the secondary power source to prevent the overcharging to the secondary power source. More particularly, the opposite ends of the power generating coil are shortcircuited by a limiter or the like to halt the charging to the secondary power source as the voltage at the secondary power source exceeds a reference level. At this time, a large shortcircuit current flows through the power generating coil. When drive pulses are given to the drive coil of the drive motor under such a state, the leakage flux from the power generator causes the drive motor to fail, resulting in improper time indication.

Particularly, since an analog indication type electronic timepiece using quartz oscillator is required to be of very high precision, it will be remarkably degraded in commercial value by the aforementioned malfunction in operation.

SUMMARY OF THE INVENTION

It is therefore an object of the present invention to an analog indication type electronic timepiece which can prevent its drive motor from failing during an anti-overcharging in which overcharging to the secondary power source is prevented, resulting in accurate analog indication, and a method for charging the secondary power source.

To this end, the present invention provides an analog indication type electronic timepiece comprising:

power generation means for transforming kinetic energy produced by motions of a user into electric energy and for causing the electric energy to output from a power generation coil as electric charging energy;

a secondary power source charged with said electric charging energy;

anti-overcharging means which forms a bypass circuit for causing said electric charging energy to bypass said secondary power source when voltage of said secondary power source reaches a predetermined level, thereby preventing overcharging to the secondary power source;

a timepiece circuit driven by charged energy of said secondary power source to output motor drive pulses;

a drive motor including a drive coil and a drive rotor which is rotatably driven when the drive coil is energized by said motor drive pulses; and current limiting means for forcedly limiting bypass current flowing through said bypass circuit when the motor drive pulses are being output from said timepiece circuit.

According to the present invention, the kinetic energy produced by motions of the user is transformed into the electric energy through the power generation means. The electric energy is then output from the power generation coil as an electric charging energy which is in turn used to charge the secondary power source.

The timepiece circuit is driven by the charged energy from the secondary power source to output the drive pulses. When the drive coil is energized by the drive pulses, the drive rotor in the drive motor is rotatably driven to perform the analog time indication.

When the secondary power source is charged to a predetermined voltage level by the power generation means, the anti-overcharging means forms the bypass circuit for the secondary power source. Thus, the charging energy output from the power generation coil of the power generation means will pass through the bypass circuit without charging the secondary power source.

At this time, a large current flows through the power generation coil to produce large magnetic flux. Part of such magnetic flux becomes a leakage flux which crosses the drive motor to cause a malfunction therein.

The present invention provides the current limiting means for forcedly limiting the bypass current flowing through said bypass circuit when the motor drive pulses are being output from said timepiece circuit. This can greatly reduce the influence of the magnetic flux from the power generation coil to the drive motor as the motor drive pulses is being output from the timepiece circuit. Therefore, the drive motor can be positively driven by the .motor drive pulses to make an accurate analog time indication.

In such a manner, the present invention can provide an analog indication type electronic timepiece which can prevent a malfunction in the drive motor during the anti-overcharging operation to make an accurate analog time indication.

The above limitation of the bypass current may be intended to reduce the magnitude of the bypass current or to block the bypass current.

In the present invention, it is preferred that the current limiting means is in the form of forced cutoff means for forcedly breaking the bypass circuit in the anti-overcharging means as the motor drive pulses are output from the timepiece circuit.

In such a manner, the current limiting means is formed in the form of forced breaking means for forcedly breaking off the bypass circuit in the anti-overcharging means as the motor drive pulses are output from the timepiece circuit. Thus, the influence of the magnetic flux from the power generation coil to the drive motor when the motor drive pulses are being output from the timepiece circuit can be remarkably reduced to make a more accurate analog time indication.

In the present invention, it is also preferred that said power generation means comprises:

an oscillating weight which is rotatably mounted and transforms kinetic energy produced by motions of the user into rotational motion; and a power generator including a power generation rotor rotatably driven by said rotational motion, said power generator being operative to cause the electric charging energy to output from said power generation coil as a charging voltage by the rotation of the power generation rotor.

According to the present invention, the kinetic energy produced by the user's motions is transformed into the rotational motion through the oscillating weight, which is in turn used to rotate the rotor of the power generator. Thus, the electric charging energy can be effectively output from the power generation coil of the power generator.

In the present invention, it is further preferred that said anti-overcharging means comprises switch means for ON/OFF controlling a short circuit in the secondary power source and wherein said forced breaking means is operative to detect output timing for said motor drive pulses for forcedly turning said switch means off as the motor drive pulses are being output.

Thus, the anti-overcharging means is formed by the switch means for ON/OFF controlling the bypass circuit in the secondary power source. The switch means i s further turned on or off by the forced breaking means. This can provide a simplified circuit for preventing the overcharging and yet for preventing a malfunction in the drive motor as the overcharging is being avoided.

In the present invention, it is still further preferred that said forced breaking means may be operative to detect when the overcharging in the secondary power source is avoided by said anti-overcharging means and to forcedly break the bypass circuit in the anti-overcharging means prior to output of the motor drive pulses, the bypass circuit being reconnected after the output of motor drive pulses have been terminated.

During the anti-overcharging operation, the bypass circuit of the anti-overcharging means is forcedly broken prior to output of the motor drive pulses. After the output of the motor drive pulses has been made, the bypass circuit is reconnected. Thus, a malfunction in the drive motor during the anti-overcharging operation can be positively prevented.

If the electronic timepiece is a wrist watch, the present invention can provide an analog indication type electronic wrist watch having an automated winding and charging function.

The present invention also provides a method of charging a secondary power source which is a drive power source of a timepiece circuit for outputting motor drive pulses toward a drive coil of a drive motor, said method comprising the steps of:

transforming kinetic energy produced by motions of a user into electric energy which is output as an electric charging energy from a magnetic coil to charge the secondary power source;

forming a bypass circuit for causing said electric charging energy to bypass said secondary power source to prevent the overcharging to the secondary power source when voltage of said secondary power source reaches a predetermined level; and forcedly limiting bypass current flowing through said bypass circuit when the motor drive pulses are being output from said timepiece circuit.

Thus, the present invention can provide a method of charging the secondary power source in the analog indication type electronic timepiece without resulting in a malfunction of the drive motor during the anti-overcharging operation.

The present invention further provides an analog indication type electronic timepiece comprising:

power generation means for transforming kinetic energy produced by motions of a user into electric energy and for causing the electric energy to output from a power generation coil as electric charging energy;

a secondary power source charged with said electric charging energy;

anti-overcharging means which forms a bypass circuit for causing said electric charging energy to bypass said secondary power source when voltage of said secondary power source reaches a predetermined level, thereby preventing overcharging to the secondary power source;

a timepiece circuit driven by charged energy of said secondary power source to output motor drive pulses; and a drive motor including a drive coil and a drive rotor which is rotatably driven when the drive coil is energized by said motor drive pulses, said timepiece circuit being operative to output a motor drive pulse containing, in its latter half, an anti-reverse area for preventing reverse rotation of said drive rotor.

In the analog indication type electronic timepiece of the present invention, the kinetic energy produced by motions of the user is transformed into the electric energy by the power generation means, the electric energy being then output from the power generation coil as an electric charging energy which is in turn used to charge the secondary power source.

The timepiece circuit is energized by the charged energy of the secondary power source to output the drive pulses. As the drive pulses are passed through the drive coil, the rotor of the drive motor is rotatably driven to perform the analog time indication.

When the secondary power source is overcharged by said power generation means, the anti-overcharging means forms the bypass circuit. Thus, the charging energy output from the power generation coil of the power generation means will pass through the bypass circuit without charging the secondary power source.

At this time, a large current will pass through the power generation coil. Part of the magnetic flux produced by the power generation coil becomes a leakage flux which brings about a malfunction in the drive motor.

When the inventors had fully studied the cause of such a malfunction from a viewpoint different from above description, he has found the following facts:

FIG. 6 shows characteristics in a drive motor used in an analog indication type electronic timepiece. In this figure, the horizontal axis indicates pulse widths of drive pulses while the vertical axis indicates voltages.

When the drive motor is not influenced by the magnetic flux from the power generation coil and if the pulse widths and voltage levels of the drive pulses are set within a normal operation range 1300 except an inoperative region 1000, the drive motor can be normally actuated. The inoperative region 1000 is one in which the energy of the motor drive pulses is insufficient to rotate the rotor.

Thus, the pulse widths of the motor drive pulses are set to avoid the inoperative region 1000. In addition, the reference voltage level of the drive pulses is also set to have more or less allowance such that it will not lower to the inoperative region 1000 even if there is more or less variations in voltage.

When the drive pulses are set in the above manner, normally, the drive motor can be positively actuated.

If a large current passes through the power generation coil as the overcharging to the secondary power source is being prevented, however, part of the produced magnetic flux becomes a leakage flux which passes the drive motor. Thus, a return malfunction region 1100 will be created in the drive motor, as shown in FIG. 6. Such a return malfunction region 1100 is one in which the rotor rotated to its advanced position is forcedly returned to its original position by too large energy from the drive pulses. This means that the rotor is not fully rotated.

It is natural that the voltage of the secondary power source is very high during the anti-overcharging operation. As a result, the motor drive pulses output from the timepiece circuit will have higher voltages under the influence of very high voltage in the secondary power source. Therefore, the drive pulses will tend to be contained in a newly produced return malfunction region 1100. The inventors have found that this might cause the malfunction in the motor.

To avoid such a problem, the present invention provides a motor drive pulse containing, its latter half, an anti-reverse area for preventing the reverse rotation of the drive rotor. Thus, it can be avoided that the rotor of the drive motor is reversed in rotation and is returned to its original static and stable position past its target static and stable position. This can rotatably drive the drive rotor in the positive manner.

In such a manner, the present invention can prevent any malfunction in the drive motor due to the anti-overcharging means of the secondary power source to make an accurate analog indication.

Tn the present invention, it is further preferred that the timepiece circuit detects anti-overcharging operation for the secondary power source and outputs the motor drive pulse containing, at its latter half, the anti-reverse area for preventing reverse rotation of the drive rotor when said anti-overcharging operation is detected.

Although the motor drive pulse may be output to contain said anti-reverse area at all times from the principle of the present invention, this raises a problem in power consumption. It is therefore preferred that a motor drive pulse not containing the anti-reverse area is normally output and that the anti-charging operation to the secondary power source is detected, a motor drive pulse containing the anti-reverse area is then output.

In the present invention, it is further preferred that said timepiece circuit outputs an anti-reverse area consisting of intermittent pulses.

This can more reduce the power consumption in the secondary power source. Moreover, the anti-reverse area can be set to be longer. This can be more positively prevent the return malfunction of the drive rotor.

In the present invention, it is further preferred that said power generation means includes an oscillating weight which is rotatably mounted and transforms kinetic energy produced by motions of the user into rotational motion and a power generator including a power generation rotor rotatably driven by said rotational motion, said power generator being operative to cause the electric charging energy to output from said power generation coil as a charging voltage by the rotation of the power generation rotor.

An electronic timepiece of the present invention comprises:

power generation means for transforming kinetic energy produced by motions of a user into electric energy and for causing the electric energy to output from a power generation coil as electric charging energy;

a secondary power source charged with said electric charging energy;

anti-overcharging means which forms a bypass circuit for causing said electric charging energy to bypass said secondary power source when voltage of said secondary power source reaches a predetermined level, thereby preventing overcharging to the secondary power source;

a timepiece circuit driven by charged energy of said secondary power source to output motor drive pulses; and a drive motor including a drive coil and a drive rotor which is rotatably driven when the drive coil is energized by said motor drive pulses, whereby voltage level of said motor drive pulses is lowered down to a level equal to or lower than a return malfunction area of said drive motor when the overcharging to said secondary power source is being prevented.

In such an arrangement, said secondary power source may include a secondary cell to be charged by said electric charging energy, a voltage increasing circuit for increasing voltage of said secondary cell and an auxiliary cell to be charged by output voltage of said voltage increasing circuit, said voltage increasing circuit being operative to reduce the voltage increasing level such that voltage level of said motor drive pulses will be equal to or lower than said return malfunction area when the overcharging to said secondary power source is being prevented.

The timepiece circuit may be formed to reduce voltage level of said motor drive pulses to a level equal to or lower than said return malfunction area when the overcharging to said secondary power source is being prevented.

In such an arrangement, the voltage level of the motor drive pulses may be reduced to a level equal to or lower than a newly produced return malfunction area 1100 so that the malfunction of the drive motor can be prevented as the overcharging to the secondary power source is being avoided.

The voltage level of the motor drive pulses may be controlled by either of the voltage increasing circuit or timepiece circuit.

The present invention further provides a method of charging a secondary power source which is a drive power source of a timepiece circuit for outputting motor drive pulses toward a drive coil of a drive motor, said method comprising the steps of:

transforming kinetic energy produced by motions of a user into electric energy which is output as an electric energy from a power generation coil to charge the secondary power source;

forming a bypass circuit for causing said electric charging energy to bypass said secondary power source to prevent the overcharging to the secondary power source when voltage of said secondary power source reaches a predetermined level; and outputting a motor drive .pulse containing, in its latter half, an anti-reverse area for preventing reverse rotation of said drive rotor when said bypass circuit is formed.

Thus, the present invention can provide a method of charging an analog indication type electronic timepiece, which can charge a secondary power source in the analog indication type electronic timepiece without causing a malfunction in the drive motor during the anti-overcharging operation to the secondary power source.

The present invention is further characterized by a method of charging a secondary power source which is a drive power source of a timepiece circuit for outputting motor drive pulses toward a drive coil of a drive motor, said method comprising the steps of:

transforming kinetic energy produced by motions of a user into electric energy which is output as an electric energy from a power generation coil to charge the secondary power source;

forming a bypass circuit for causing said electric charging energy to bypass said secondary power source to prevent the overcharging to the secondary power source when voltage of said secondary power source reaches a predetermined level; and outputting a motor drive pulse having its voltage level equal to or lower than a return malfunction area of said drive motor when said bypass circuit is formed.

Thus, the present invention can provide a method of charging an analog indication type electronic timepiece, which can charge a secondary power source in the analog indication type electronic timepiece without causing a malfunction in the drive motor during the anti-overcharging operation to the secondary power source.

The electronic timepiece of the present invention preferably comprises:

a housing;

a movement disposed within said housing; and a ring-shaped inside frame located between said housing and said movement for preventing an undesirable play in the movement, said inside frame including an empty portion to insert an external operation unit into the interior of said housing and a bridge portion bridging said empty portion, an oscillating weight of said power generation means eccentrically and rotatably mounted on said movement on the opposite side of said empty portion.

It is preferred that the eccentricity of said oscillating weight may be substantially equal to half of the extension of the bridge portion toward the oscillating weight plus half of the gap between said bridge portion and said oscillating weight.

Alternatively, the eccentricity of said oscillating weight may be substantially equal to half of the extension of the external operation unit into the inside frame through said empty portion plus half of the gap between the extension of said external operation unit and the oscillating weight.

It is preferred that said bridge portion is formed on an inner periphery of said inside frame as a ring-shaped shock absorbing member having its inner periphery which is located on a circle concertric to a rotational locus of the oscillating weight. As an impact is received, the inner periphery of said shock absorbing member protects said oscillating weight.

It is preferred that a part of said ring-shaped shock absorbing member on the side opposite to said empty portion is cut out by a length within the outer periphery of said oscillating weight.

The electronic timepiece of the present invention preferably comprises:

a drive gear train mechanism for transmitting the rotational output of said drive motor to an indication portion; and a drive train wheel bridge for supporting said drive gear train mechanism, said power generation means including:

a oscillating weight rotatably mounted on a oscillating weight bridge for transforming kinetic energy produced by motions of the user into rotational motion;

a power generator including a power generation rotor rotatably driven by said rotational motion, said power generator being operative to cause the electric charging energy to output from said power generation coil as a charging voltage by the rotation of the power generation rotor; and a power generation gear train mechanism for transmitting the rotational motion of said oscillating weight to said power generation rotor, said power generator including a power generation stator for flowing magnetic flux from said power generation rotor into the power generation coil, said power generation stator forming a magnetic circuit with said power generation rotor and coil, said power generator being operative to cause the electric charging energy to output from said power generation coil as a charging voltage by the rotation of said power generation rotor, said train wheel bridge being disposed between at least part of a first power generation gear train in said power generation gear train mechanism located on the side opposite to the support surface of said oscillating weight bridge and a bearing located opposite to the oscillating weight in said first power generation gear train, said train wheel bridge including an aperture formed therethrough for receiver one end of rotating shaft of said first power generation gear train.

Said first power generation gear train is preferably formed so that one end of its shaft portion will pass through an aperture formed through said power generation stator.

The power generation stator preferably has its aperture formed therethrough to have a diameter substantially equal to that of the aperture formed through said train wheel bridge.

It is preferred that said train wheel bridge includes an aperture formed therethrough to have its tapered periphery for guiding rotary shaft.

It is further preferred that said train wheel bridge is located between said power generation coil and said power generation gear train to prevent a contact between the power generation gear train and the power generation coil.

It is further preferred that a magnetic core of said power generator is of a multi-layered structure including magnetic layers of different shapes.

It is further preferred that one magnetic core of said magnetic cores of multi-layered structure on the side of said oscillating weight is superimposed on and connected to the power generation stator in a direction of thickness of the timepiece to form the magnetic circuit.

It is further preferred that said magnetic cores of multi-layered structure have the same shape of core layers in at least coil winding portion.

It is further preferred that said power generator includes coil frames on the opposite ends of the power generation coil for preventing a disturbance in coil windings and that the position of each of said coil frames is defined by a magnetic core layer in multi-layered structure, the entire length of said magnetic coil being invariable.

The analog indication type electronic timepiece of the present invention preferably comprises a holding member in which said bearing of said first power generation gear train is formed, the position of the contact surface between said power generation stator and said holding member being located closer to the holding member than a surface of said power generation stator on the side of said holding member adjacent to said power generation rotor.

The analog indication type electronic timepiece of the present invention preferably includes a movement circuit board located between said first power generation gear train and said oscillating weight.

BRIEF DESCRIPTION OF THE DRAWINGS

FIG. 15A is a plan view and FIG. 15B is a cross-sectional view taken along a line 15B—15B in FIG. 15A.

DETAILED DESCRIPTION OF THE PREFERRED EMBODIMENTS

First Embodiment

The first embodiment of the present invention will now be described in detail in connection with an analog indication type electronic wrist watch.

Figure 2:
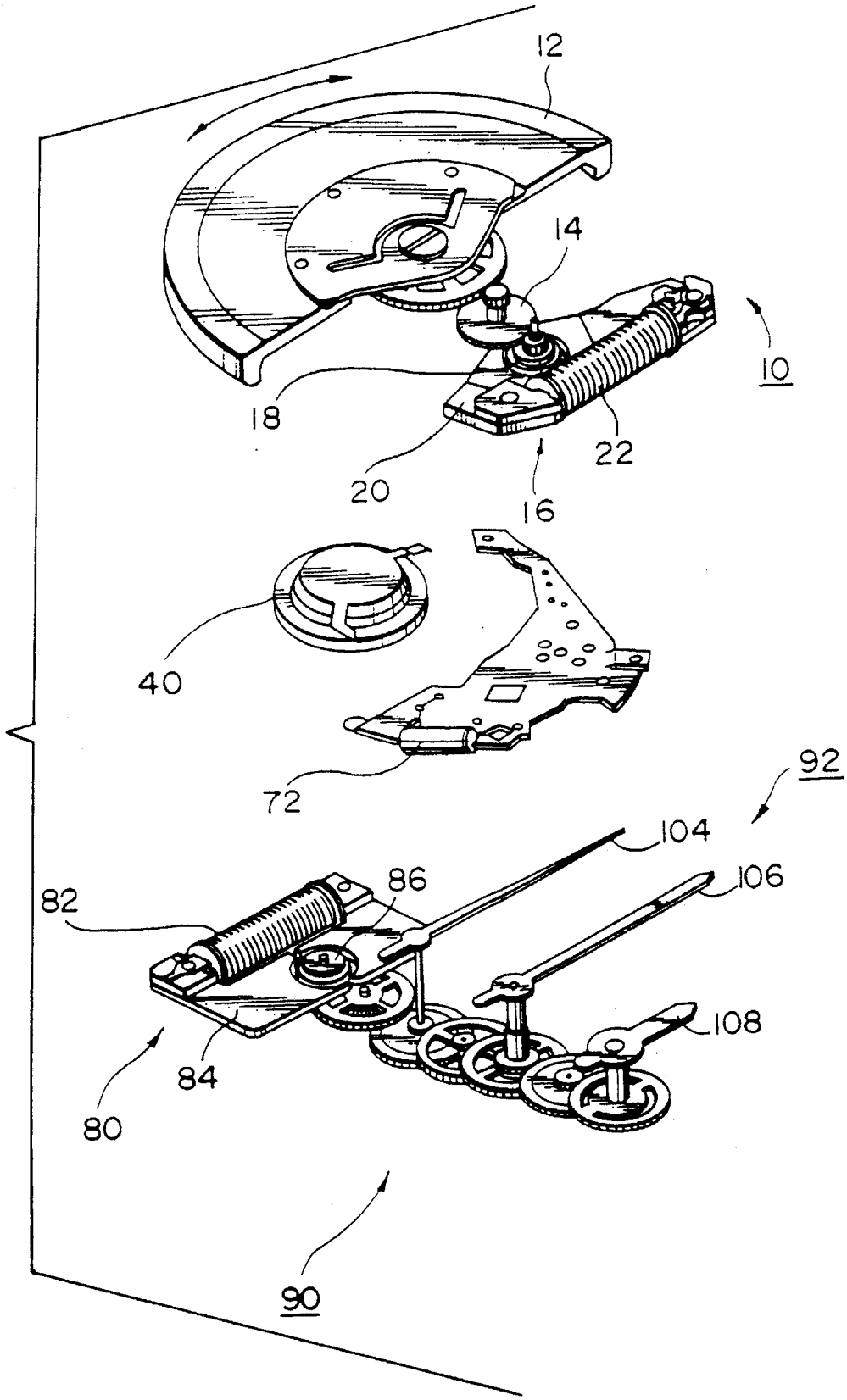
FIG. 2 illustrates the primary mechanical parts of the electronic timepiece of one embodiment.

FIG. 2 shows a power generation means 10 and an indicating system 92 which are used in the electronic wrist watch of the first embodiment.

The power generation comprises a means 10 semicircle-shaped oscillating weight 12 rotatably mounted on a base plate in the watch case, a gear train mechanism 14 for increasing the rotational speed of the oscillating weight 12 and a power generator 16 including a power generation rotor 18 which is rotatably driven through the gear train mechanism 14.

As a user moves his or her arm on which the electronic wrist watch is mounted, the oscillating weight 12 is rotated, with kinetic energy so produced being transformed into a rotational motion as shown by an arrow in FIG. 2. The rotational speed of the oscillating weight 12 is increased about 100 times through the gear train mechanism 14 and then transmitted to the power generation rotor 18 which consists of north and south pole permanent magnets. As the power generation rotor 18 is rotated at a high speed in such a manner, it changes its magnetic flux passing through a power generation coil 22 through a power generation stator 20.

Figure 1:
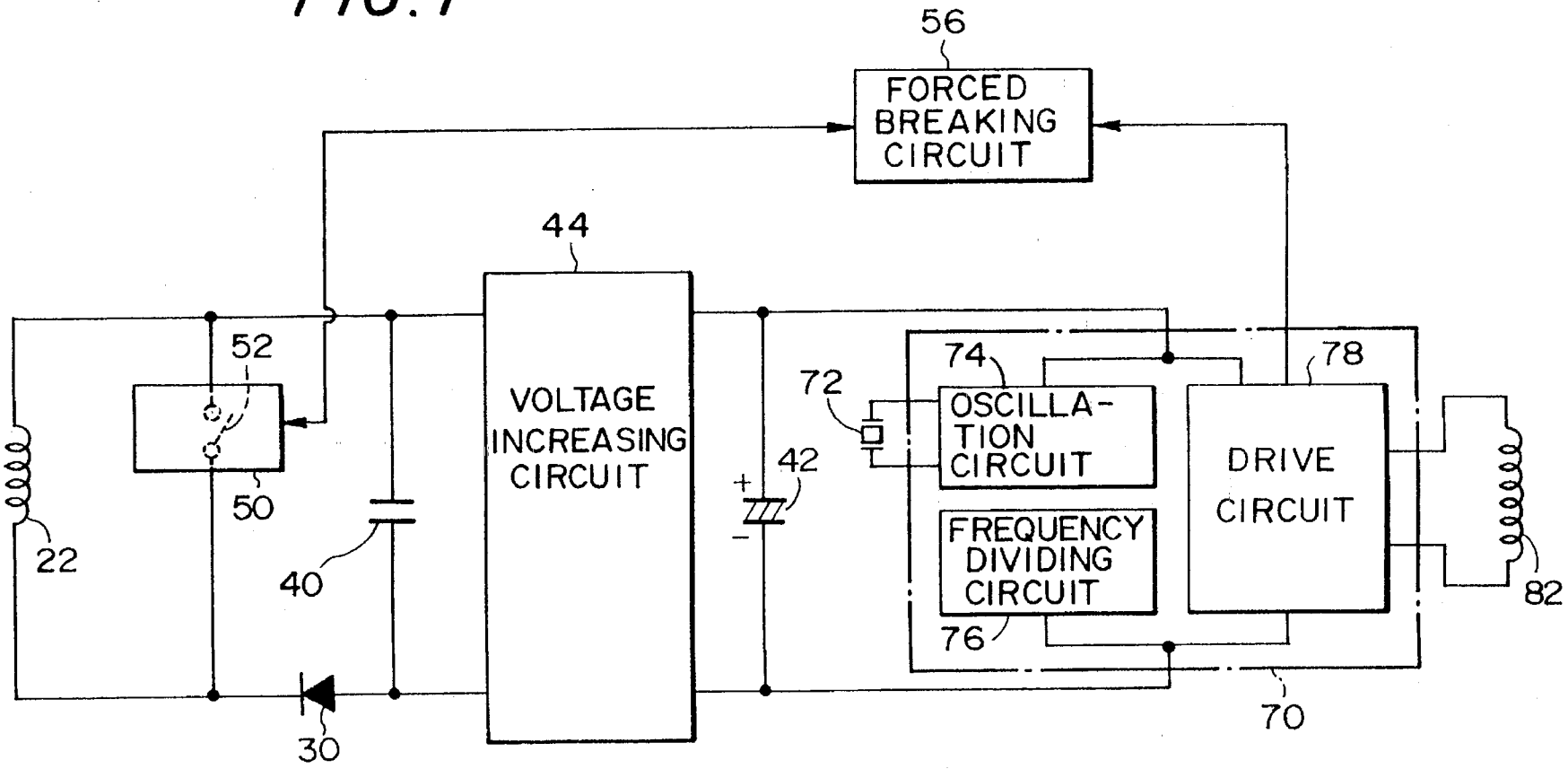
FIG. 1 is a circuit diagram of one embodiment of an analog indication type electronic timepiece constructed in accordance with the present invention.

As the magnetic flux is changed, the electromagnetic induction causes the power generation coil 22 to output an AC voltage which is in turn rectified by a rectifying diode 30 shown in FIG. 1. The rectified voltage is then used to charge a capacitor 40 that is used as a secondary cell. The capacitor 40 supplies a smoothed electric energy to drive a timepiece circuit 70 which uses a quartz oscillator 72.

The capacitor 40, a voltage increasing circuit 44 and auxiliary capacitor 42 constitute a secondary power source. As the power generator 16 is actuated, the capacitor 40 will be charged. In this embodiment, the capacitor 40 is of a large capacitance of 0.33 F and adapted to be charged within a range capacitor voltage between 0.45 V and 2.2 V. If the capacitor voltage is insufficient to drive the timepiece, the voltage increasing circuit 44 increases the capacitor voltage to a level sufficient to drive the timepiece. The power thus increased is accumulated in the auxiliary capacitor 42. Thus, the actual power source used to drive the timepiece is provided by the auxiliary capacitor 42. In this embodiment, this auxiliary capacitor 42 is of 15 μF and charged by the voltage increasing circuit 44 to have its output voltage ranging between 1.1 V and 2.2 V.

Figure 4A:
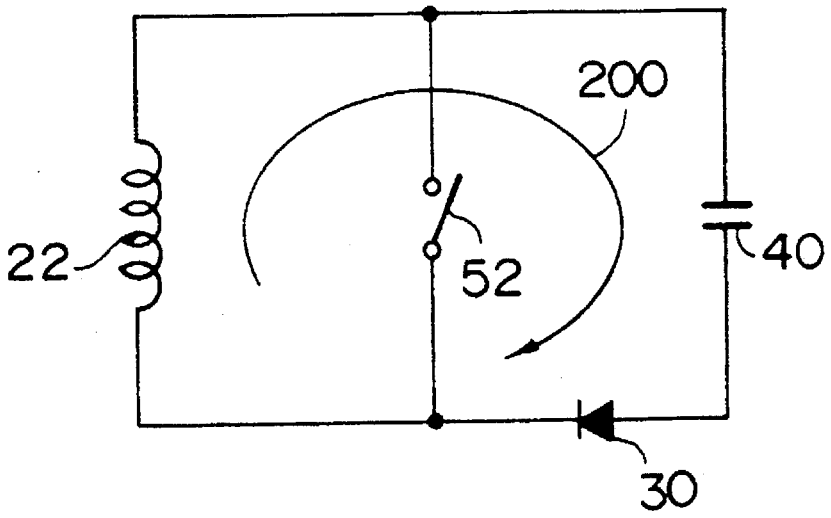
FIG. 4A is a schematic view illustrating charging to a secondary cell and FIG. 4B is a schematic view illustrating an anti-overcharging operation.
Figure 4B:
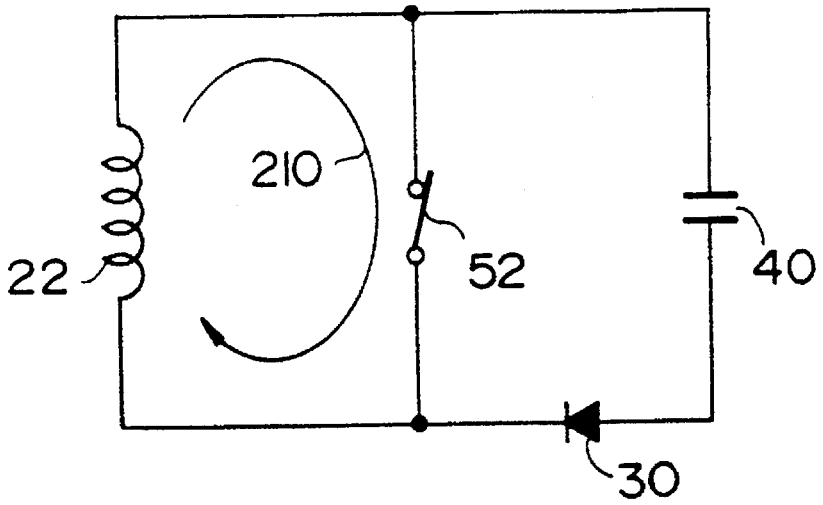

To avoid the overcharging of the capacitor 40, a limiter circuit 50 is provided to function as anti-overcharging means. The limiter circuit 50 includes .a switch component 52 for ON/OFF controlling a bypass circuit. When the charged voltage of the capacitor 40 exceeds a reference overcharging level (which is 2.2 V in this embodiment), the switch component 52 is turned on to form the above bypass circuit. Thus, a current 200 charging the capacitor 40 as shown in FIG. 4A flows through the bypass circuit formed by the limiter circuit 50 as shown in FIG. 4B. This prevents the overcharging to the capacitor 40.

Figure 5:
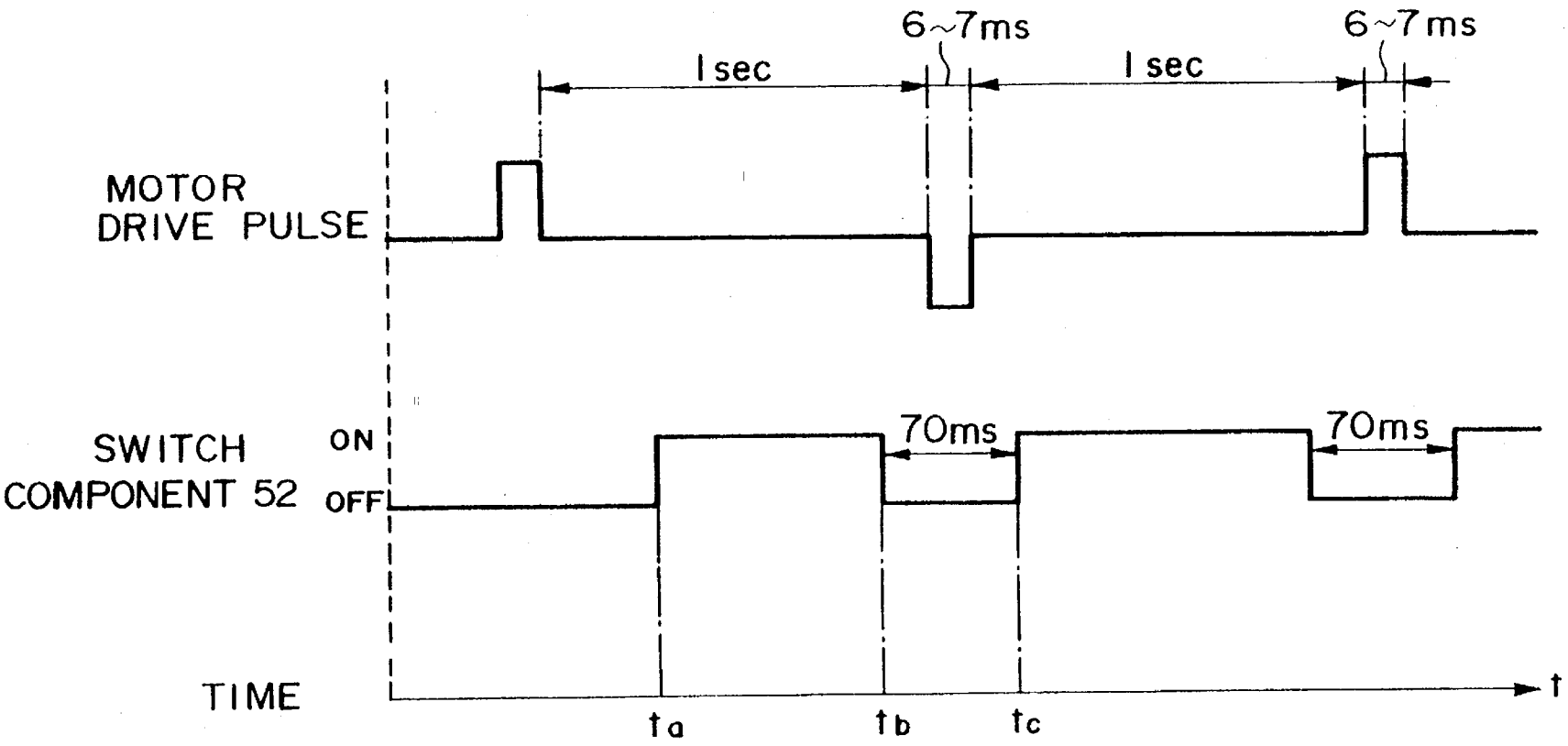
FIG. 5 is a timing chart illustrating the operation of the electronic timepiece according to this embodiment.

The timepiece circuit 70 comprises an oscillation circuit 74 using a quartz oscillator 72 in its oscillating part, a frequency dividing circuit 76 for dividing the oscillation output from the oscillation circuit 74, and a drive circuit 78 responsive to the divided output for outputting drive pulses 15 different in polarity for every one second. The drive pulses are output therefrom toward a drive coil 82 in a step-motor 80 which functions as a drive motor. The drive coil 82 of the step-motor 80 is energized by one drive pulse for each one second as shown in FIG. 5. Thus, a rotor 86 in the step-motor 80 shown in FIG. 2 will be .rotatably driven through each energization of the drive coil 82.

The rotational output of the rotor 86 is transmitted respectively to second hand 104, minute hand 106 and hour hand 108 through a three-hand drive gear train mechanism 90 shown in FIG. 2. Thus, time will be shown by analog indication.

Figure 3:
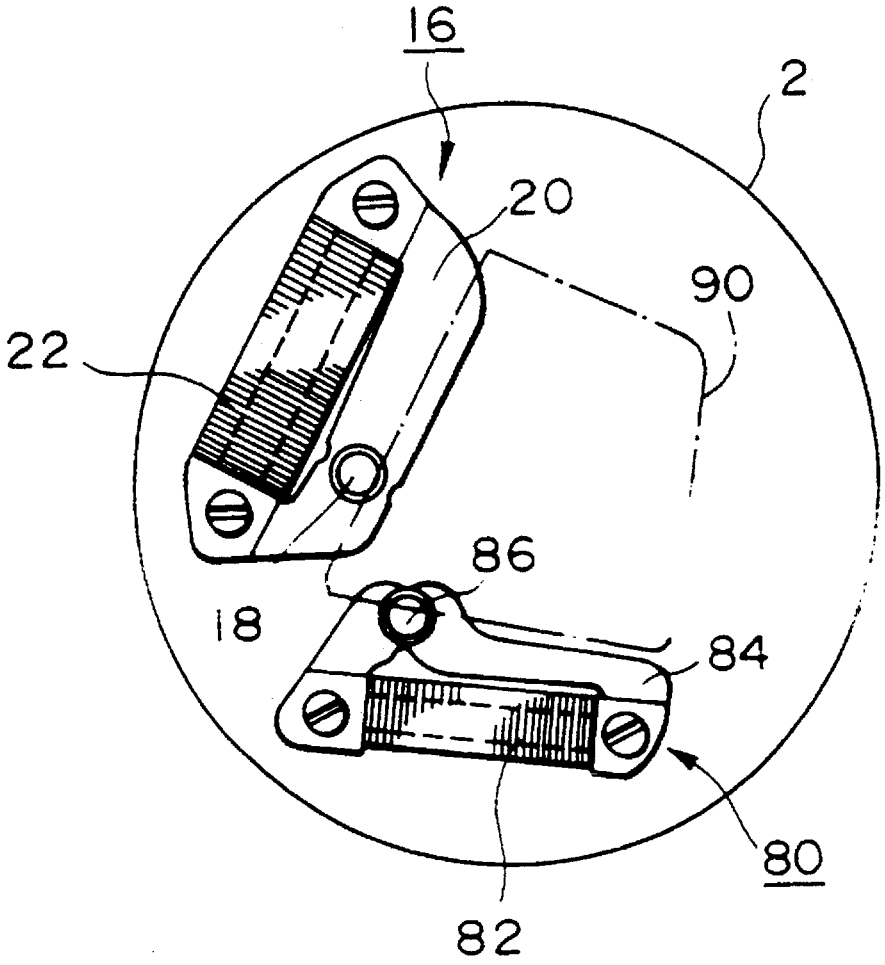
FIG. 3 illustrates the positional relationship between a power generator and a step-motor which are housed within a watch case.

In the analog indication type electronic timepiece using such an automatic winding and power generating mechanism, the power generator 16 and drive step-motor 80 will be mounted within the watch case. In many high-compaction type electronic wrist watches of today, particularly, the generator 16 and step-motor 80 are disposed adjacent each other within the watch case 2, as shown in FIG. 3. Therefore, the step-motor 80 may be adversely affected by the magnetic flux produced by the power generator 16. Such an adverse affection increases as the magnetic flux from the generator 16 increases.

Particularly, if the switch component 52 of the limiter circuit 50 is turned on to perform an anti-overcharging operation and when the oscillating weight 12 is rotated to make the power generation, a shortcircuit current flows through the power generation coil 22, as shown in FIG. 4B. The shortcircuit current may cause a malfunction that when the magnetic flux from the power generator 16 increases, the rotor 86 does not rotate in spite of application of drive pulses to the step-motor 80.

To avoid such a malfunction, the electronic timepiece of this embodiment includes such a forced breaking circuit 56 as shown in FIG. 1, which functions to forcedly shift the switch component 52 of the limiter circuit 50 to its OFF position during output of the drive pulses. This cuts off the bypass circuit for preventing the overcharging. Thus, the magnetic flux from the power generation coil 22 can be greatly reduced during output of the drive pulses. The step-motor 80 can be rotatably driven in the relicable manner.

FIG. 5 shows the details of the forced breaking operation in this embodiment. The forced breaking circuit 56 detects the anti-overcharging operation in the capacitor 40 being the secondary cell, depending on the state of the limited circuit 50. At a time ta shown in FIG. 5, the switch component 52 of the limiter circuit 50 is turned on to initiate the anti-overcharging operation. At this time, the forced breaking circuit 56 detects an output timing for drive pulses based on the internal state of the drive circuit 78. Prior to output of the drive pulses, the forced breaking circuit 56 controls the switch component 52 such that the latter is turned off. After the output of the drive pulses have been terminated, the switch component 52 is returned to its ON position.

The detection of the drive pulses is based on a counted value for the divided output from the drive circuit 78 when the drive pulses are output therefrom. In other words, the drive circuit 78 will output drive pulses at each time when the counted value reaches a value corresponding to one second. Therefore, the forced breaking circuit 56 forcedly turns the switch component 52 off at time tb which is about 30 ms. before output of the drive pulses based on the count value of the drive circuit 78. At time tc which is about 30 ms. after output of the drive pulses, the switch component 52 is returned to its ON state.

By forcedly turning the switch component 52 off sufficiently prior to the output of the drive pulses, the malfunction of the step-motor 80 during the anti-overcharging operation to the secondary cell can be prevented in the reliable manner. If the limiter circuit 50 does not make the aforementioned anti-overcharging operation, the switch component 52 will not forcedly be turned off by the forced breaking circuit 56.

The present invention is not limited to the first embodiment mentioned above, but may be carried out in any one of various modified or changed forms within the scope of the invention.

For example, the forced breaking circuit 56 may be replaced by any other suitable means such as a current-limiting circuit for limiting a bypass current into a lowered level.

Although the first embodiment has been described in connection with the wrist watch, the present invention may be applied to any one of various other portable timepieces.

Second Embodiment

The second preferred embodiment of the present invention will be described in connection with an analog indication type electronic timepiece. However, parts corresponding to those of the first embodiment are designated by the same reference numerals, but will not further be described.

The inventors have fully studied the mechanism of producing the aforementioned malfunction and a countermeasure for overcoming the malfunction from a viewpoint other than that of the first embodiment.

FIGS. 10A–10D illustrates the general principle of operation in the step-motor 80.

Figure 8:
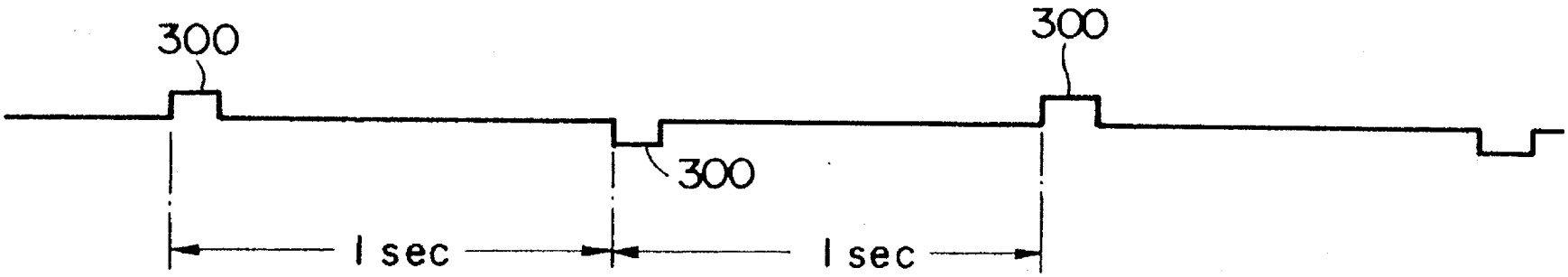
FIG. 8 illustrates motor drive pulses output toward the step-motor.

As pulses 300 different in polarity from one another as shown in FIG. 8 are output from the timepiece circuit 70 toward the drive coil 82 of the step-motor 80 for every one second, the rotor 86 is rotated step by step by 180 degrees to drive the gear train mechanism 90.

Figures 10A, 10B, 10C, 10D:
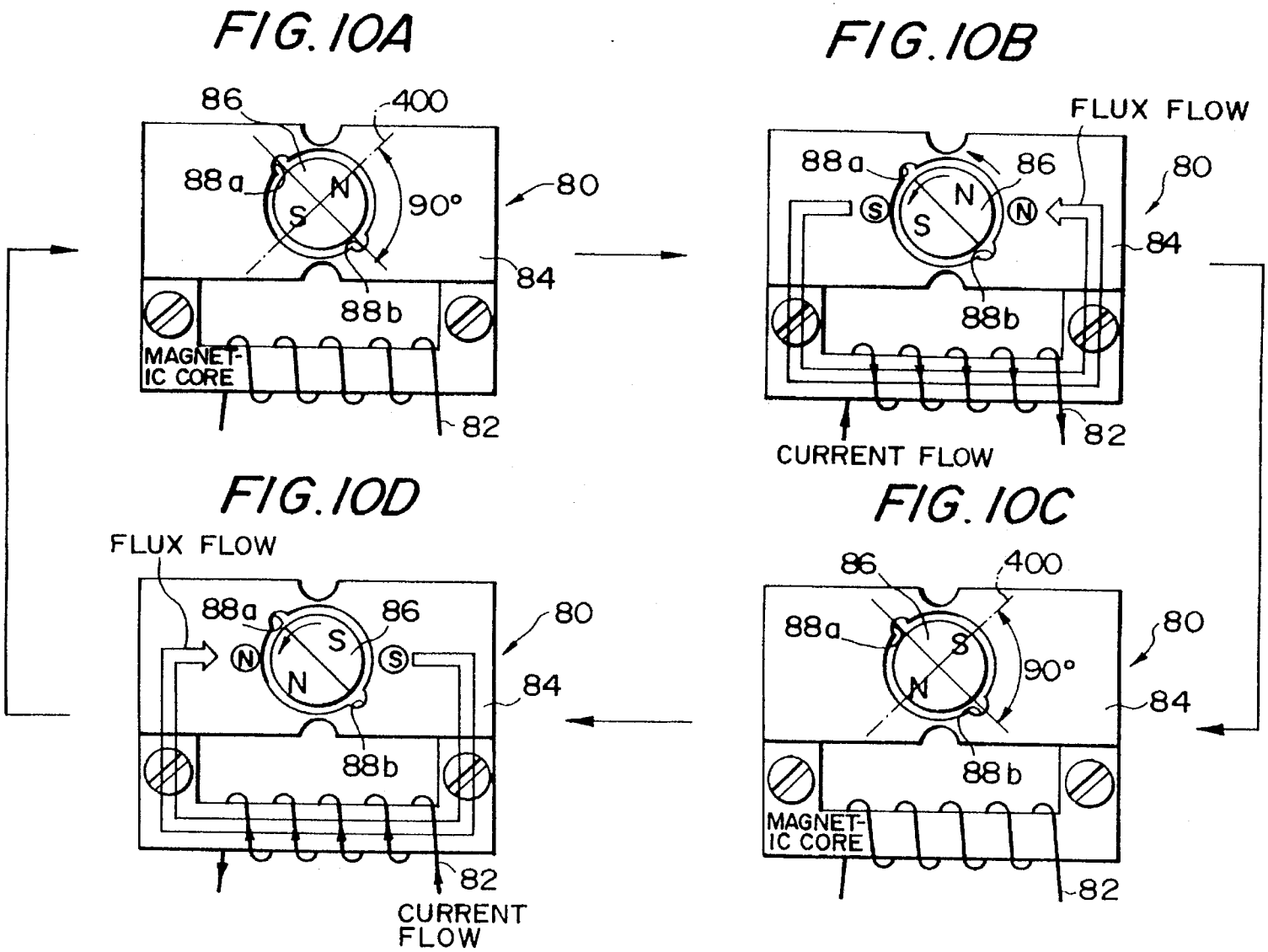
FIGS. 10A–10D illustrate the operation of a step-motor used in the electronic timepiece of the present invention.

For example, if the rotor is not moved as shown in FIG. 10A, that is, if the drive coil is not energized by the motor drive pulse, the magnetic poles of the rotor 86 stay at a static and stable position 400 shown in FIG. 10A. This is because the respective magnetic poles of the rotor 86 tend to move to positions spaced away from inside notches **88*a* and 88*b* as much as possible. As a result, the magnetic poles of the rotor 86 will stay at the static and stable position offset from the respective inside notches 88*a* and 88*b*** by 90 degrees.

Figure 9A:
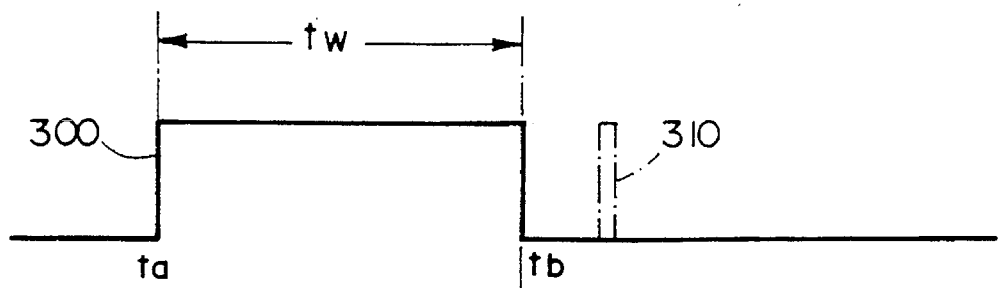
FIGS. 9A–9D illustrate the details of the motor drive pulses.

When the drive coil 82 is energized by a drive pulse 300 under this condition as shown in FIG. 10B, a magnetic field is produced in the coil 82 under the same principle as in electromagnet to create a magnetic flux in the magnetic core and stator 84 as shown by arrow in FIG. 10B. Thus, north and south poles are produced on the stator 84. The north and south poles of the rotor 86 are respectively repelled by the north and south poles of the stator 84, resulting in rotation of the rotor 86 by 180 degrees in the direction of arrow. As shown in FIG. 9A, the drive pulse 300 used herein is set to have the minimum pulse width tw and voltage level required to rotate the rotor 86 in the reliable manner for such a purpose as saves the power consumption.

When the rotor 86 is rotated by 180 degrees, the north and south poles of the rotor 86 are stopped at the static and stable position 400, as shown in FIG. 10C. This is because a force of the inside notches 88*a* and 88*b* tending to stop the rotor is larger than the inertia rotating force of the rotor 86. It is to be noted that the north and south poles of the rotor 86 are positioned opposite to those of the rotor shown in FIG. 10A.

The setting of the drive pulse 300 at the minimum pulse width has been described in the summary. Even if the drive pulse 300 is applied to the drive coil 82, it may be produced a phenomenon called a midway stop in which the rotor 86 does not move to the position of FIG. 10B and is stayed at a position intermediate between the positions of FIGS. 10B and 10C for any reason. Such a midway stop is detected by measuring changes of the current through the drive coil 82. If the midway stop is detected; the drive coil 82 outputs a stabilizing pulse 310 as shown by one-dot chain line in FIG. 9A. The stabilizing pulse 310 causes the rotor 86 to move to the next static and stable position 400 shown in FIG. 10C. The details of such a technique is described in Japanese Patent Publication No. Sho 62-43149.

As the drive coil 82 is energized by another drive pulse 300 having a different polarity as shown in FIG. 10D, the rotor 86 is rotated by 180 degrees in the direction of an arrow to the static and stable position shown in FIG. 10A whereat the rotor is stayed.

In such a manner, the rotor 86 of the step-motor 80 is rotated by 180 degrees at a time for every output of the drive pulse.

To make the positive actuation of the step-motor 80, there is a problem in what manner the motor drive pulses output from the timepiece circuit should be set.

Figure 6:
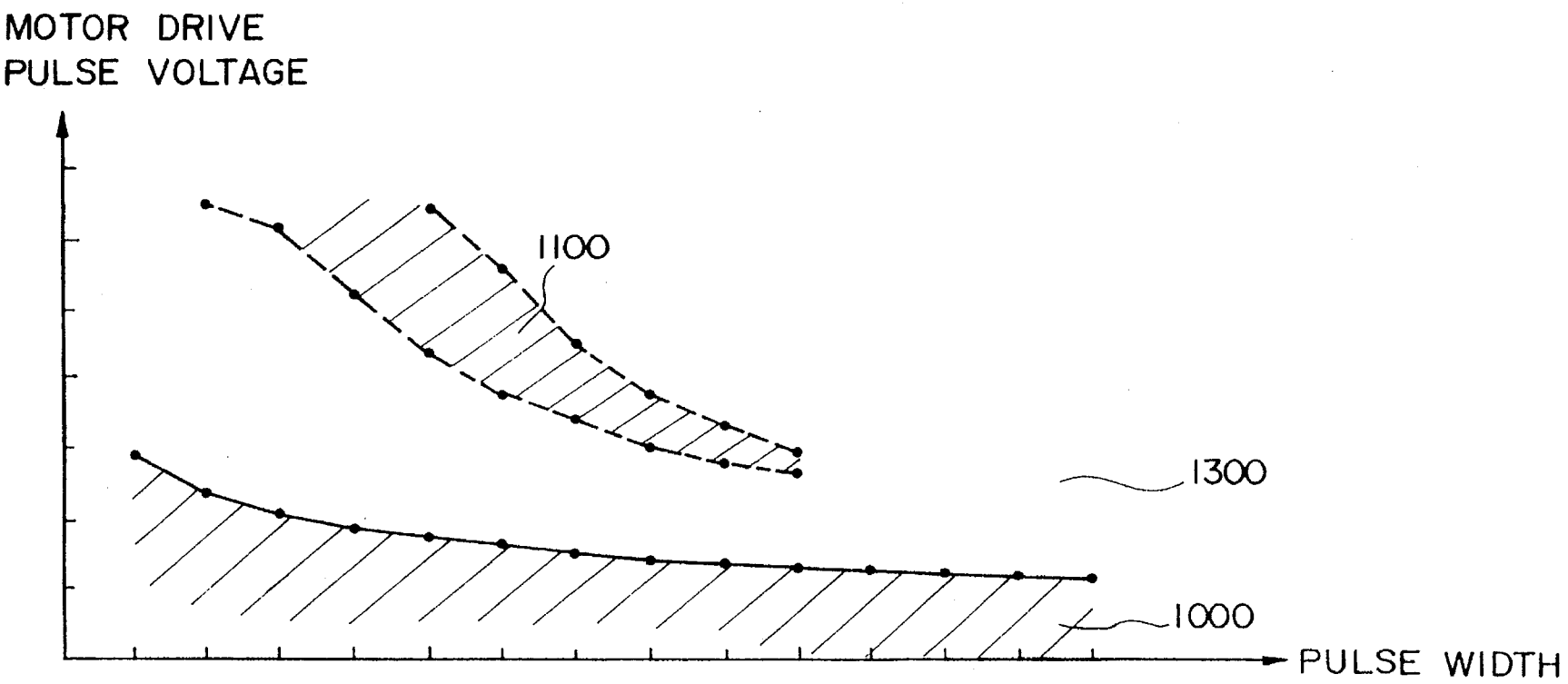
FIG. 6 illustrates the operational characteristics of the step-motor relative to motor drive pulses.

FIG. 6 shows the operational characteristics of the step-motor 80 relative to the motor drive pulses. The operational characteristics are measured when the step-motor 80 is mounted within the timepiece case.

The fact that there is an inoperative region 1000 if the step-motor will not adversely be affected by the magnetic flux from the power generation coil 22 has been described. Therefore, the motor drive pulse 300 must be set to be included in the normal operation region 1300.

By using the drive pulse 300 so set, the step-motor 80 can be reliably driven in the normal operation.

However, when the limiter circuit 50 initiates to generate a shortcircuit current shown in FIG. 4B to prevent the overcharging to the capacitor 40, the magnetic flux from the power generator 16 increases to produce a new return malfunction region 1100 in the step-motor 80. This has also been described in the summary.

Since the voltage of the capacitor 40 becomes equal to 2.2 V under such an overcharging state, the voltage of the auxiliary capacitor 42 also increases to 2.2 V. This also increases the voltage level of the drive pulse 300 output from the timepiece circuit 70. As a result, the voltage of the drive pulse 300 will be included in the return malfunction region 1100.

When the motor drive pulse set based on the normal operation is directly used in the anti-overcharging operation to the capacitor 40, the return malfunction may be produced in the rotor 86.

FIGS. 11A to 11E illustrate the return malfunction produced in the step-motor 80.

Figure 11A:
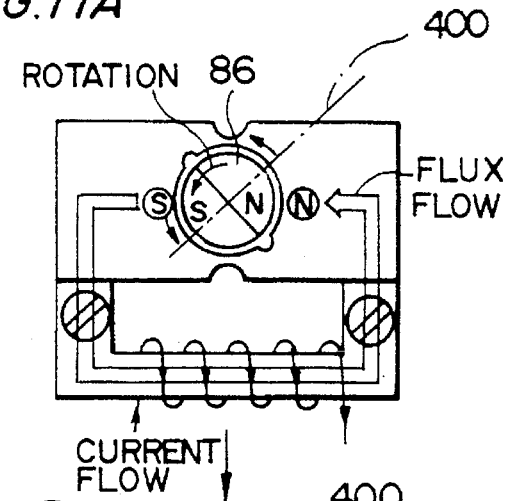
FIGS. 11A–11G illustrate the return malfunction of the step-motor with the principle of the present invention.
Figure 11B:
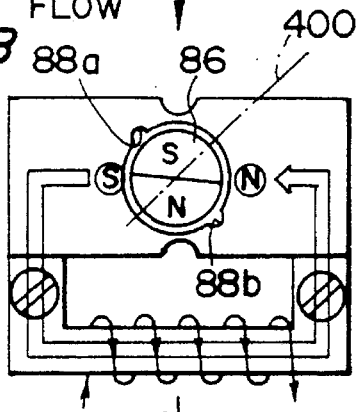

When the drive coil 82 is energized by a drive pulse as shown in FIG. 11A, the rotor 86 is initiated to rotate to the next static and stable position 400 in the direction of an arrow. The pulse width of the drive pulse 300 has been set such that the drive pulse 300 is placed in OFF state immediately before and after the north and south poles of the rotor 86 pass through the inside notches 88*a* and 88*b* when the rotor is normally rotated. During the anti-overcharging operation to the secondary cell, however, rotating force of the rotor 86 becomes larger than the normal torque since the voltage of the drive pulse 300 increases. Therefore, the rotor 86 will be rotated with an acceleration higher than the normal one. As a result, the drive pulse will not be turned off even when the north and south poles of the rotor 86 pass the next static and stable position 400 and reaches the reverse position, as shown in FIG. 11B. The north and south poles of the rotor 86 are magnetically attracted respectively by the S-and N-poles of the stator 84 to continue the rotation of the rotor 86 toward a target static and stable position 400 while being accelerated.

Figure 11C:
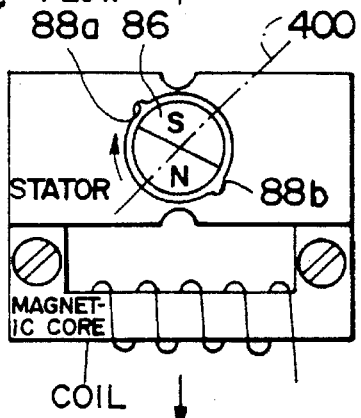
Figure 11D:
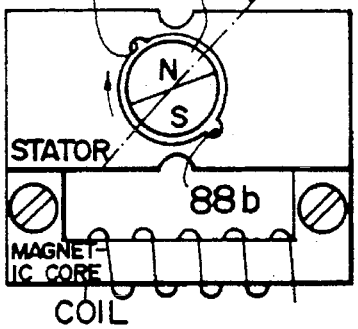
Figure 11G:
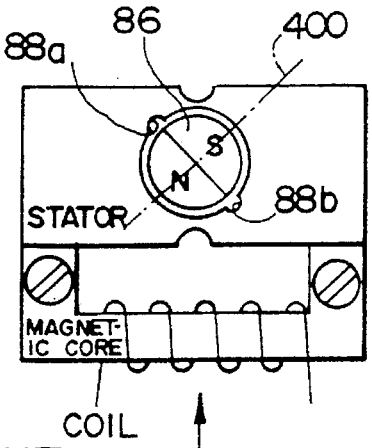
Figure 11F:
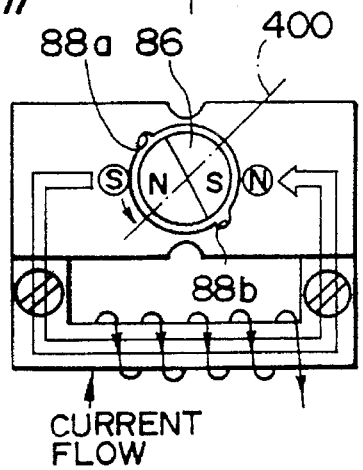
Figure 11E:
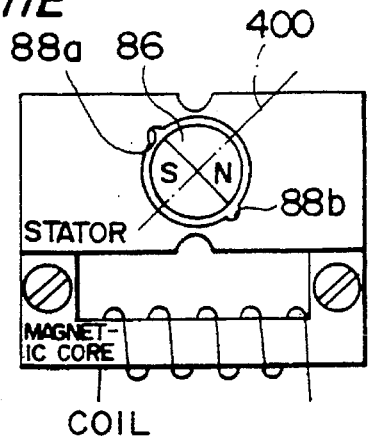

When the drive pulse 300 is turned off at a position shown in FIG. 11C, the rotor 86 passes the target static and stable position 400 under its inertia. The rotor 86 further moves past the inside notches 88*a* and 88*b* as shown in FIG. 11D. Finally, the rotor 86 will return to the original static and stable position 400, as shown in FIG. 11E.

This causes the return malfunction in the rotor 86. As a result, the rotor 86 will be in the same state as it does not fully rotate, even if the drive pulse is applied to the drive coil.

Figure 7:
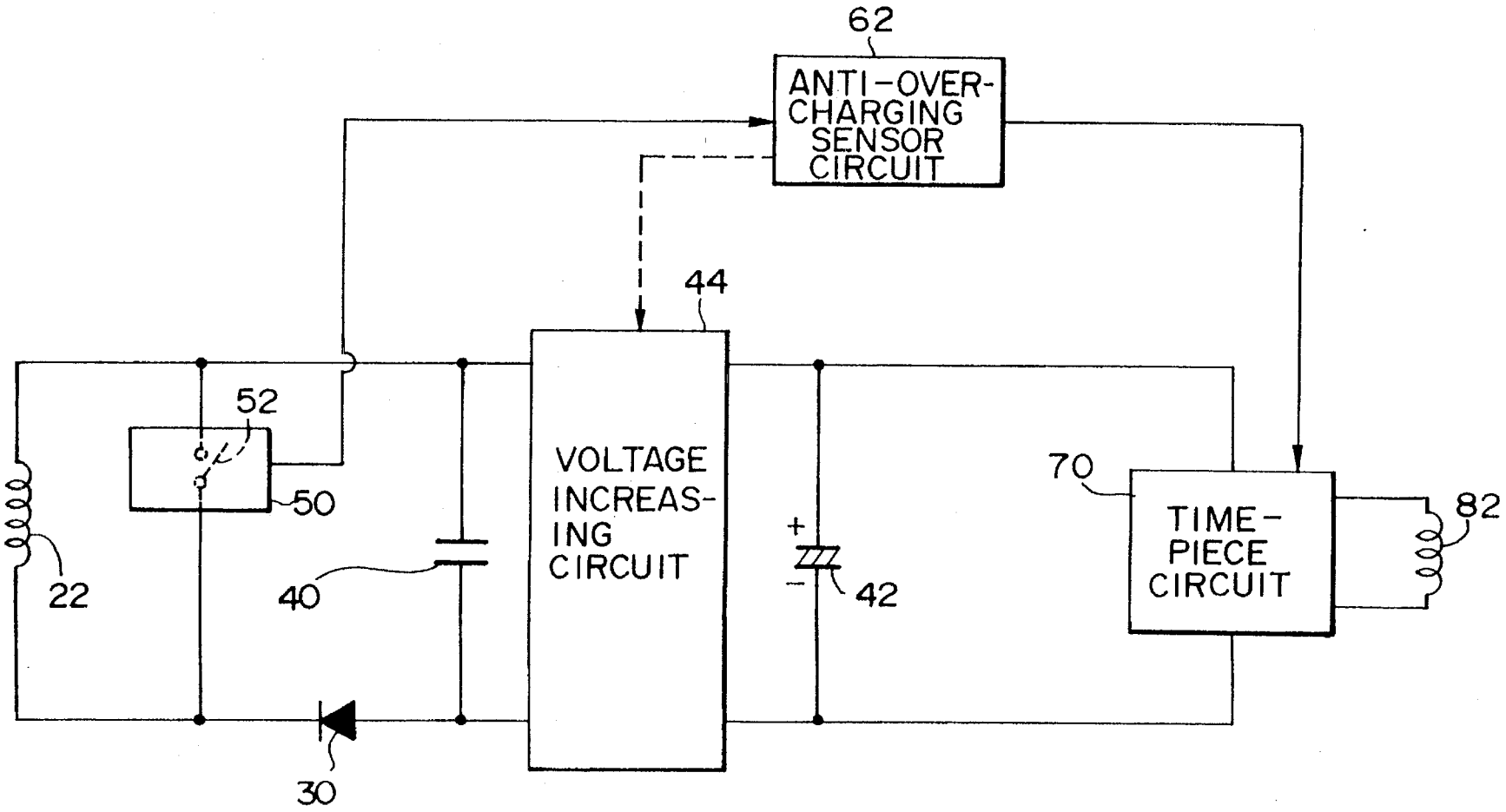
FIG. 7 is a circuit diagram of the second embodiment of an analog indication type electronic timepiece constructed in accordance with the present invention.

To avoid such a return malfunction in the rotor 86, the second embodiment provides an anti-overcharging sensor circuit 62 responsive to the ON/OFF states of the switch component 52 for sensing whether or not the anti-overcharging operation to the capacitor 40 is performed, as shown in FIG. 7. The output of the sensor circuit 62 is applied to the timepiece circuit 70.

If the anti-overcharging operation is not executed, the timepiece circuit 70 outputs a normal drive pulse 300 having its pulse width tW shown in FIG. 9A. If the anti-overcharging operation is sensed, the timepiece circuit 70 then outputs another drive pulse 300 which includes an original drive pulse area 300*a* and an anti-reverse area 300*b* for preventing the reverse of the drive rotor after the drive pulse area 300*a*, as shown in FIG. 9B.

Figure 9B:
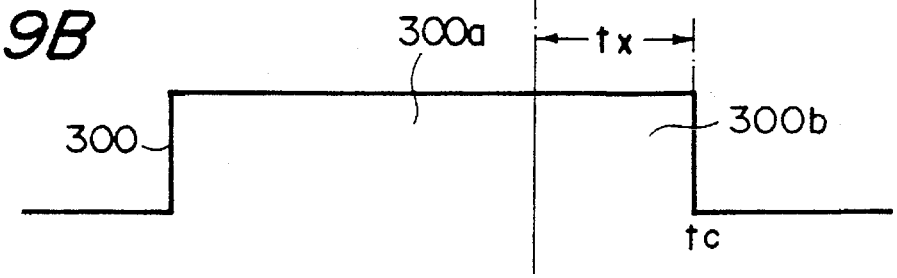

Even though the position of the rotor shown in FIG. 11C is at time tb wherein the drive pulse area 300*a* shown in FIGS. 9A and 9B terminates, the timepiece circuit 70 will continuously output a drive pulse having its anti-reverse area 300*b* as shown in FIG. 9B. As the rotor 86 passes through the target static and stable position 400 under the inertia thereof as shown in FIG. 11F, a magnetic attraction functioning to return the rotor 86 to its forward rotational direction is produced between the S- and N-poles of the stator 84 and the north and south poles of the rotor 86. Even if the drive pulse 300 is thereafter turned off, the rotor 86 can be returned to and stayed at the target static and stable position 400 shown in FIG. 11G.

By causing the latter half of the drive pulse 300 to include the anti-reverse area 300*b* for the drive rotor 86, thus, the second embodiment can reliably prevent the return malfunction in the rotor 86 during the anti-overcharging operation to the capacitor 40.

Although the motor drive pulses each of which has its latter half containing the anti-reverse area as shown in FIG. 9B may be output at all times irrespectively of whether or not the anti-overcharging operation is executed, this raises a problem in power consumption.

According to the present invention, however, the drive pulse 300 containing the anti-reverse area 300*b* as shown in FIG. 9B is output only during the anti-overcharging operation. Thus, the power consumption required to prevent the return malfunction of the rotor 86 can be saved to use the charged energy in the capacitor 40 in the effective manner.

Although the embodiment shown in FIG. 9B has been described in connection with formation of the motor drive pulses 300 output during the anti-overcharging operation into a continuous pulse waveform, the present invention is not limited to such a waveform, but may be applied to any one of various other pulse configurations, as required.

Figure 9C:
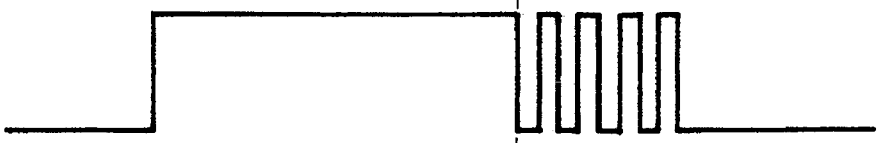

For example, the anti-reverse area 30*b* of the motor drive pulse 300 may be formed into an intermittent pulse waveform as shown in FIG. 9C. This can more save the power during output of the pulses and more effectively utilize the energy.

Figure 9D:
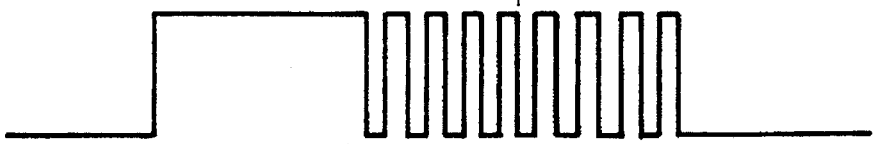

As shown in FIG. 9D, intermittent pulses may be output from the latter half of the normal pulse area 300*a* to the anti-reverse area 300*b*.

As described, the analog indication type electronic timepiece of the second embodiment uses such a drive pulse 300 as shown in FIG. 9A when the limiter circuit 50 is not actuated, and the motor drive pulses each having, at its latter half, such an anti-reverse area 300*b* as shown in FIGS. 9B to 9D are used when the limiter circuit 50 is actuated to perform the anti-overcharging operation to the capacitor 40. During the anti-overcharging operation to the capacitor 40, therefore, the malfunction in the drive motor can be reliably prevented to perform an accurate time indication.

The present invention is not limited to the second embodiment, but may be carried out in any one of various modified or changed forms within the scope of the invention.

For example, the present invention is not limited to the anti-reverse area included in the latter half of the motor drive pulse which is used to prevent the return malfunction in the rotor, but may be applied to a case where the output voltage level of the motor drive pulses is reduced below the return malfunction region 1100 of FIG. 6. It has been described that during the anti-overcharging operation, the voltage of the capacitor 40 increases to rise the voltage level of the drive pulses. If the voltage level of the motor drive pulses is reduced by a level corresponding to increase of the voltage of the capacitor 40 during the anti-overcharging operation, therefore, the malfunction in the drive motor will be avoided as in the first embodiment.

Such a control of voltage may be performed by the voltage increasing circuit 44 into which the detection output of the anti-overcharging sensor circuit 62 is input. In such a case, the voltage increasing circuit 44 reduces the voltage increasing level such that the voltage level of the motor drive pulses 300 are below the return malfunction region 1100, with the charged voltage being output toward the auxiliary capacitor 42.

Alternatively, the timepiece circuit 70 itself may be responsive to the detection of the anti-overcharging sensor circuit 62 for adjusting the voltage level of the motor drive pulses 300. In other words, the timepiece circuit 70 may output the motor drive pulses 300 having the voltage level reduced below the return malfunction region during the anti-overcharging operation to the secondary power source.

Although the second embodiment has been described in connection with the wrist watch, the present invention may similarly be applied to any one of the other suitable portable timepieces.

Third Embodiment

The third embodiment of the present invention will be described in connection with an analog indication type wrist watch.

Figure 12:
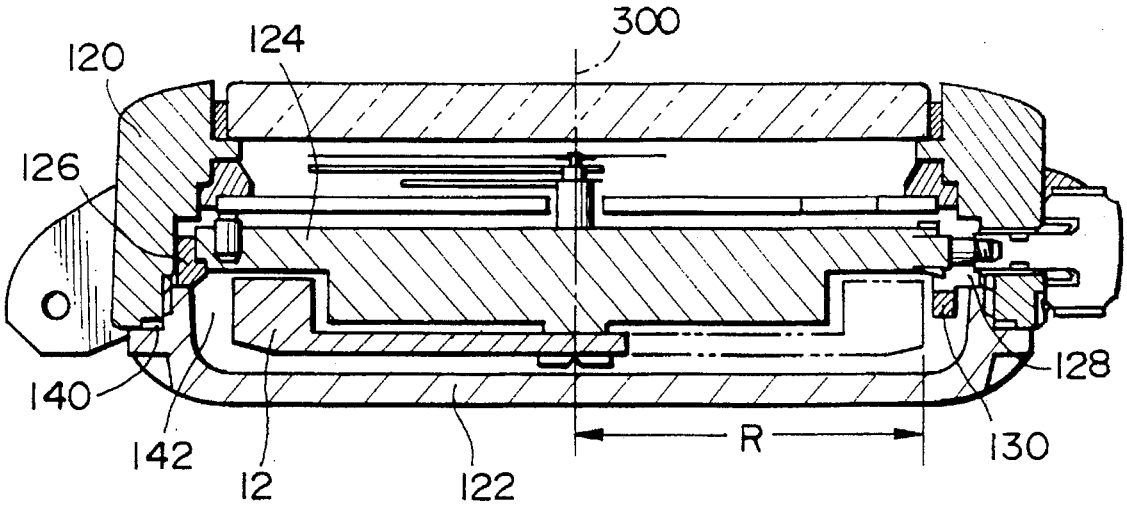
FIG. 12 PRIOR ART
FIG. 12 is a schematic cross-section of an electronic timepiece constructed in accordance with the prior art.

FIG. 12 schematically illustrates the cross-section of an analog indication type wrist watch. The electronic wrist watch comprises a case 120, a case back cover 122 and a watch housing formed by the case 120 and case back cover 122. The housing receives a movement 124 and an oscillating weight 12 rotatably mounted on the backside of the movement 124. The movement 124 is normally held by an case ring 126 within the housing to avoid undesirable plays in the radial and longitudinal directions.

A elastic sealing member 140 made of such a material as synthetic rubber OF plastic is disposed between the case back cover, 122 and the case 120. When the case back cover 122 is mounted on the case 120, the elastic sealing member 140 is pressed to secure a water resistance. This also upwardly presses the case ring 126 such that the movement 124 can be firmly mounted in the case.

When the case ring 126 is to be inserted in the case from the side of the case back cover 122, the electronic wrist watch requires a empty portion 128 in the case ring 126 for avoiding an interference with external actuating elements such as winding stem, crown, buttons and others. Since a part of the case ring 126 is completely cut away for the empty portion 128, a bridge portion 130 is formed under the empty portion 128 to avoid the external actuating elements and connect with the case ring 126. The case ring 126 is made of any one of plastics such as polyacetal and polycarbonate and metals such as Bs and SUS.

In the conventional electronic wrist watches of such an arrangement, the rotation center of the oscillating weight 12 is positioned on the center 3000 of the movement 124, as shown in FIG. 12. Thus, the turning radius R of the oscillating weight 12 is set such that the bridge portion 130 extending inwardly from the case ring 126 will not interfere with the oscillating weight 12. This permits a useless space 142 to be formed in the watch housing at a position opposite to the bridge portion 130. There will be raised a problem in that the internal space of the housing cannot be effectively utilized.

In the presence of such a space 142, the oscillating weight 12 will be not protected at all when the wrist watch is subjected to an impact. This means that the rotating shaft of the oscillating weight 12 may be damaged.

Figure 14:
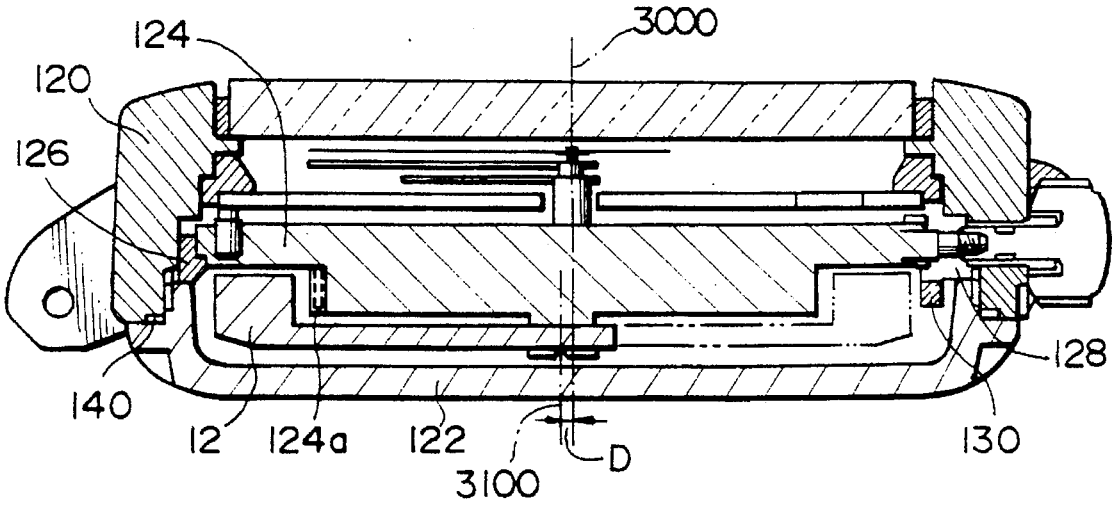
FIG. 14 is a schematic cross-section of the electronic timepiece according to the third embodiment.

To avoid such a problem, the oscillating weight 12 of the third embodiment is rotatably mounted on the movement 124 at a position eccentrically located by a distance D in the direction opposite to the empty portion 128, as shown in FIG. 14. In this figure, 3000 designates the center of the movement 124 while 3100 denotes the rotation center of the oscillating weight 12.

The details of the oscillating weight 12 will be described below.

As the oscillating weight 12 of the third embodiment is rotated through one revolution about the rotation center 3100 thereof, the rotational area of the oscillating weight 12 becomes substantially equal to the horizontal surface area of the movement 124.

The eccentricity D is set to be substantially equal to half of the extension of the bridge portion 130 from the case ring 126 toward the oscillating weight plus half of the gap between the oscillating weight 12 and the bridge portion 130. The gap can be represented by the manufacturing tolerance of parts plus the assembling tolerance.

When the external actuating elements such as crown, buttons and others extend inwardly into the case in addition to the bridge portion 130, the eccentricity D may be defined by about half of the extension of the external actuating elements beyond the case ring 126 plus half of the gap between the external actuating elements and the oscillating weight 12. As a result, the turning radius R of the oscillating weight 12 can be increased by the length of the eccentricity D.

Thus, the turning radius of the oscillating weight 12 can be set maximum in the limited space of the watch housing. As a result, the maximum kinetic energy can be provided by the oscillating weight 12 to improve the winding efficiency in the power generator.

Since the oscillating weight 12 can be enlarged horizontally, the oscillating weight 12 can be reduced in thickness assuming that the weight of the oscillating weight 12 is the same as that of the oscillating weight whose center is at the rotating shaft of the movement 124. As a result, the electronic wrist watch can be reduced in thickness.

In addition to the interference with the case ring 126 and external actuating elements, an interference between the oscillating weight 12 and the movement part disposed opposite to the inside of the oscillating weight 12 can be effectively prevented.

Figure 13:
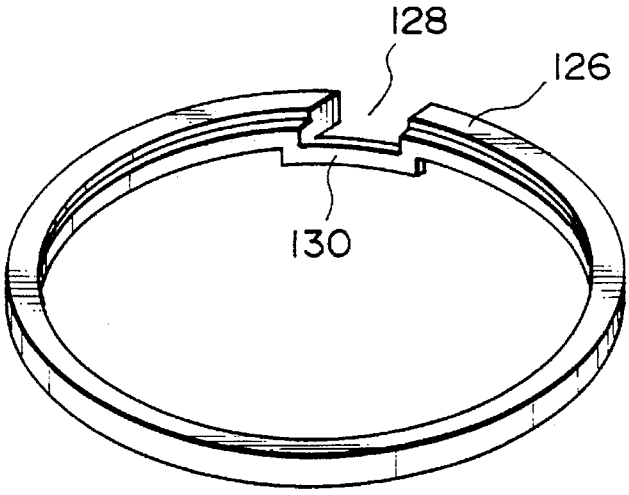
FIG. 13 is a schematic and perspective view of an inside frame used in the third embodiment of an electronic timepiece constructed according to the present invention.

The case ring 126 shown in FIG. 13 may be replaced by one shown in FIG. 15, if required.

The case ring 126 shown in FIG. 15 includes a ring-shaped bridge portion 130 extending around the inner periphery of the case ring 126. Such a ring-shaped bridge portion 130 may be used as a shock absorbing member 134. The shock absorbing member 134 has its inner periphery 132 located on a circle concentric to the rotation locus of the oscillating weight 12. In other words, the inner periphery 132 of the shock absorbing member 134 is positioned on a circle centered at the rotation center 3100 of the oscillating weight 12. In such an arrangement, the oscillating weight 12 will be rotated while maintaining a constant gap between the outer periphery Of the oscillating weight 12 and the inner periphery of the shock absorbing member 134.

Since said gap is formed to be smaller than the length which the oscillating weight 12 would move when it is subjected to a shock, the rotating shaft of the oscillating weight 12 can be prevented from being damaged by the impact between the oscillating weight 12 and the inner periphery of the shock absorbing member 134. If the electronic wrist watch is fallen, for example, with the side of nine o'clock down, the oscillating weight 12 will be displaced outwardly due to its own elasticity with any play in the mounting portion. If a gap smaller than the length of such a displacement is formed between the outer periphery of the oscillating weight 12 and the inner periphery of the shock absorbing member 134, the oscillating weight 12 can be protected against the shock.

Figure 15A:
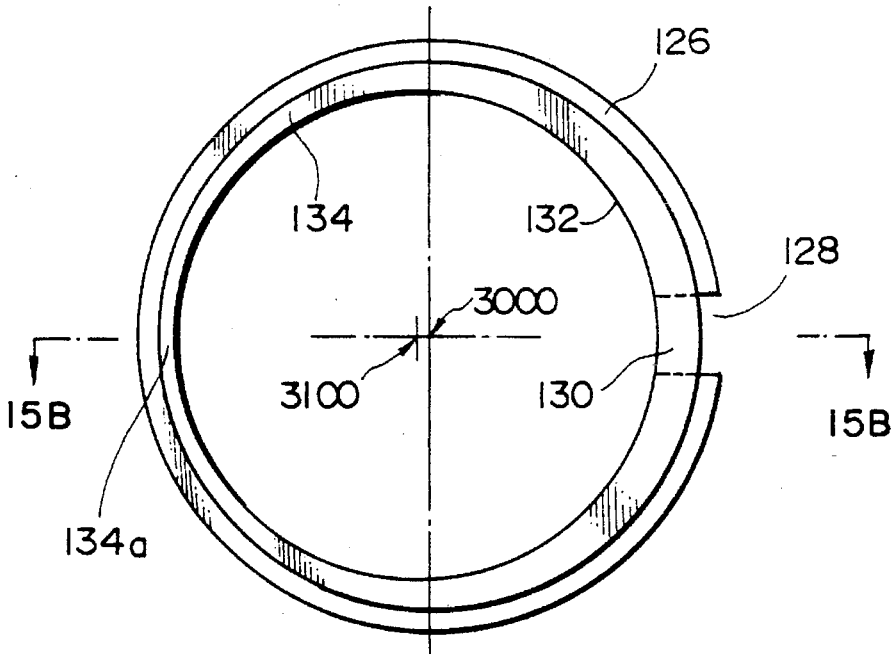
FIGS. 15A and 15B illustrate modifications of the inside frame used in the third embodiment.
Figure 15B:
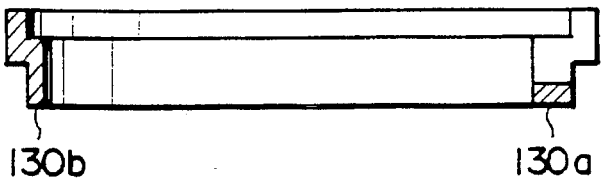

It is preferred that the cross-sectional area of the shock absorbing member 134 is substantially invariable, as shown in FIG. 15B. More particularly, when the shock absorbing member 134 is formed into an eccentric ring-shaped configuration as shown in FIG. 15A and if the shock absorbing member 134 is not subjected to any measure, it will have an increased wall-thickness on the side of the empty portion 128 and a reduced wall-thickness on the opposite side 134*a*.

To avoid such a problem and also to maintain the entire strength of the shock absorbing member 134 substantially uniform, it is preferred that the cross-section of the shock absorbing member 134 is substantially invariable as a whole, as shown in FIG. 15B.

Figure 16:
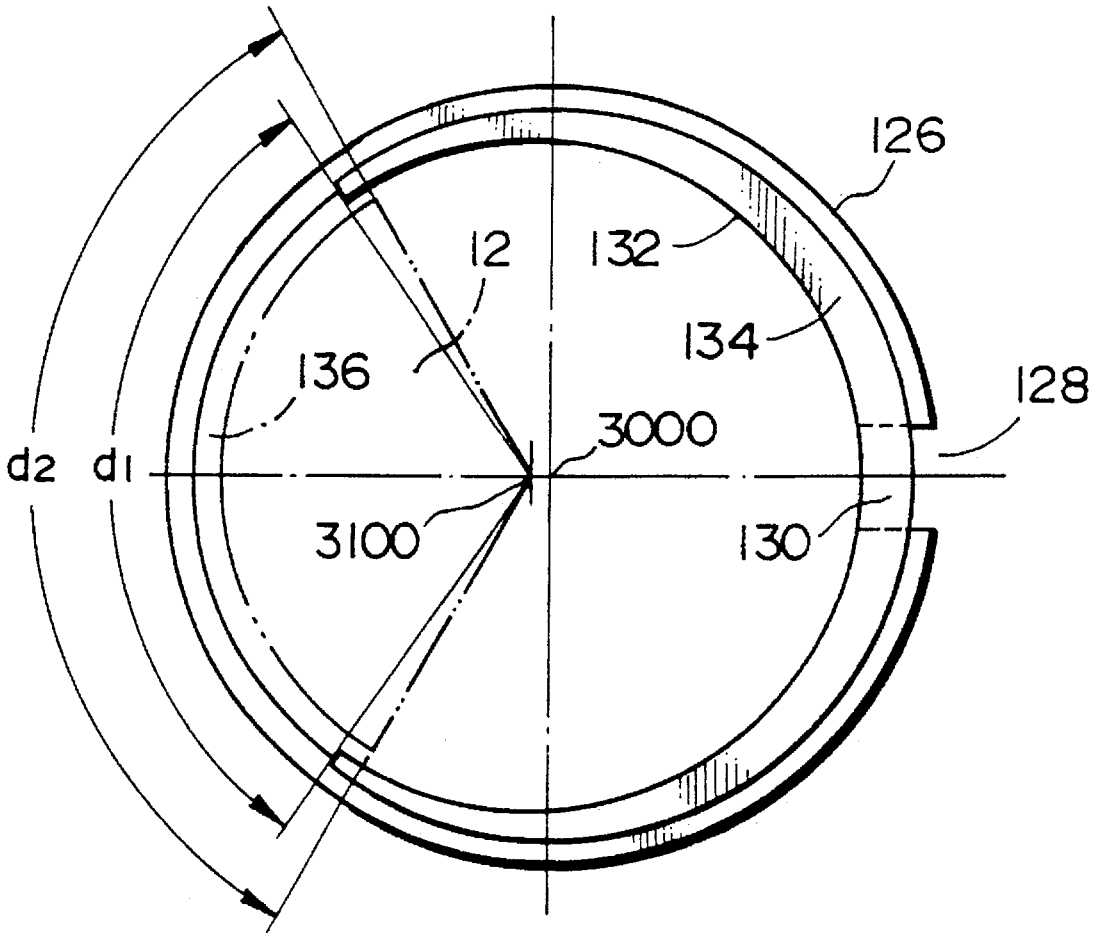
FIG. 16 is a schematic plan view of another modification of the inside frame used in the third embodiment.

In the third embodiment, the case rings 126 as shown in FIGS. 13 and 15 may be replaced by such a case ring 126 as shown in FIG. 16, if necessary. The case ring 126 shown in FIG. 16 has a shock absorbing member 134 of the same structure as that of the case ring 126 shown in FIG. 15. The case ring 126 in FIG. 16 is characterized by that a part of the shock absorbing member 134 is cut out at an area opposite to the empty portion 128. The arcuate length d1 of this cutout portion 136is smaller than the arcuate length d2 of the outer periphery of the oscillating weight 12.

In such an arrangement, the radius of the oscillating weight 12 can be increased by the wall-thickness of the cutout portion 136 to generate the power more effectively. If the length d1 is smaller than the length d2 of the outer periphery of the oscillating weight 12 and even when the electronic wrist watch is fallen with the side of nine o'clock down, part of the oscillating weight 12 necessarily impacts the inner periphery of the shock absorbing member 134 to reduce the impact against the rotating shaft of the oscillating weight 12.

Fourth Embodiment

The fourth embodiment of the present invention will be described in connection with an analog indication type electronic wrist watch.

When it is wanted to accomplish the reduced size and thickness of an analog indication type electronic wrist watch, various types of problems may be raised.

In the prior art, the movement of the electronic timepiece has different functional parts such as power generator, drive gear train mechanism, and circuits which are disposed independently in a plane. This limits the miniaturization of the electronic timepiece.

Since the gear train is not easily mounted in the bearing portion, anti-skewing dowels must be formed in the base plate.

It is considered that the gear train may be superimposed over the power generation coil to advance the miniaturization of the electronic timepiece. For any reason, however, the power generation coil may be brought into contact with the gear train, resulting in disconnection of the coil.

Various parts such as IC, quartz and so on are mounted on the circuit board for the movement. Wiring must be provided on the circuit board with sufficient allowance. As the miniaturization of the electronic timepiece is advanced, it becomes difficult to assemble the circuit board having its sufficiently available area into the electronic timepiece.

The base plate of the movement has an increased wall-thickness in its functionally important part and a relatively thin wall-thickness in the other less important part. However, the prior aft does not effort to decrease the thickness of the electronic timepiece by utilizing the variable wall-thickness of the base plate.

The fourth embodiment improves the layout of parts and anti-skewing mechanism in the analog indication type electronic wrist watch to reduce the size and thickness thereof.

Figure 17:
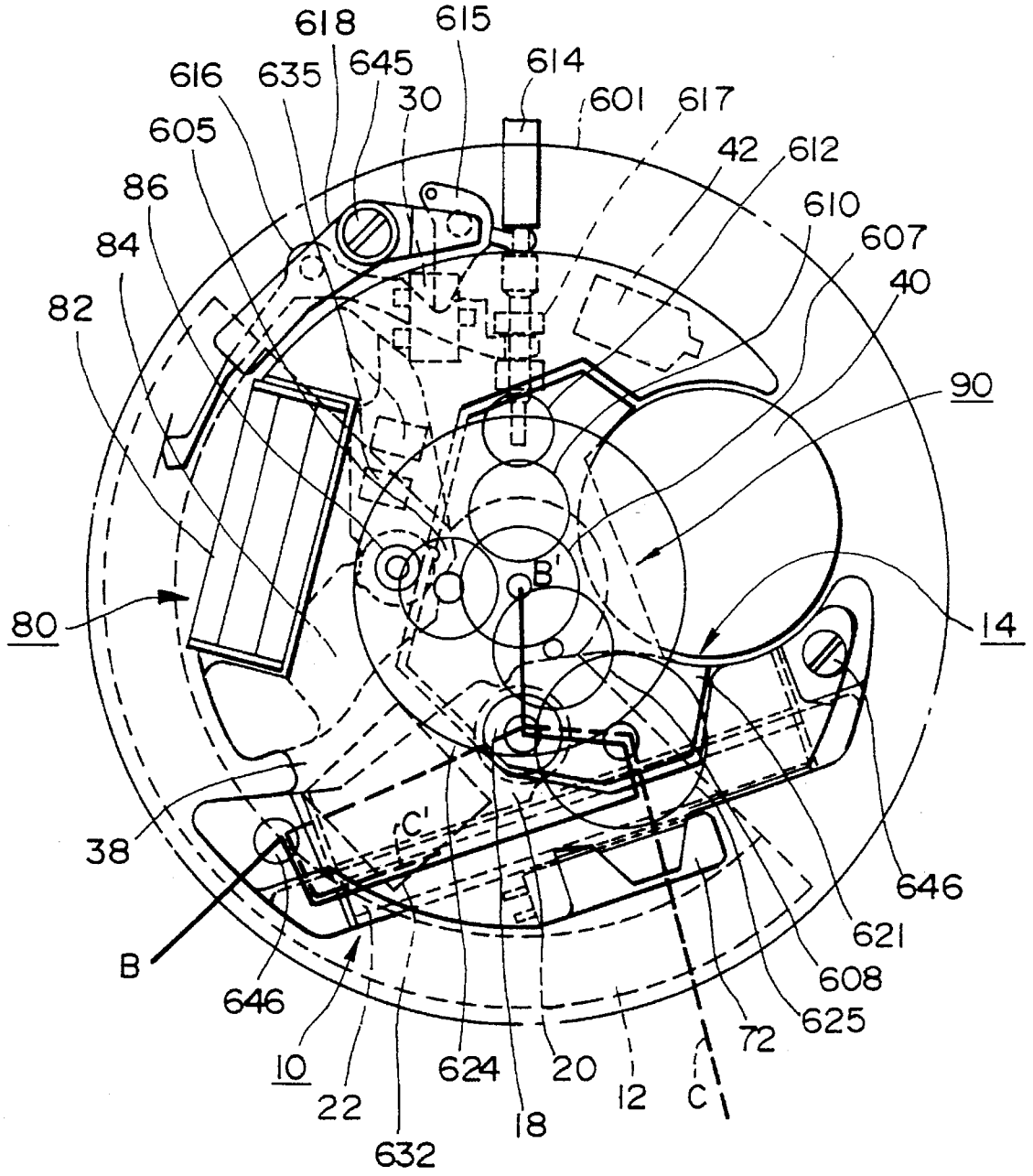
FIG. 17 is a schematic plan view of the fourth embodiment of an electronic timepiece constructed in accordance with the present invention.
Figure 18:
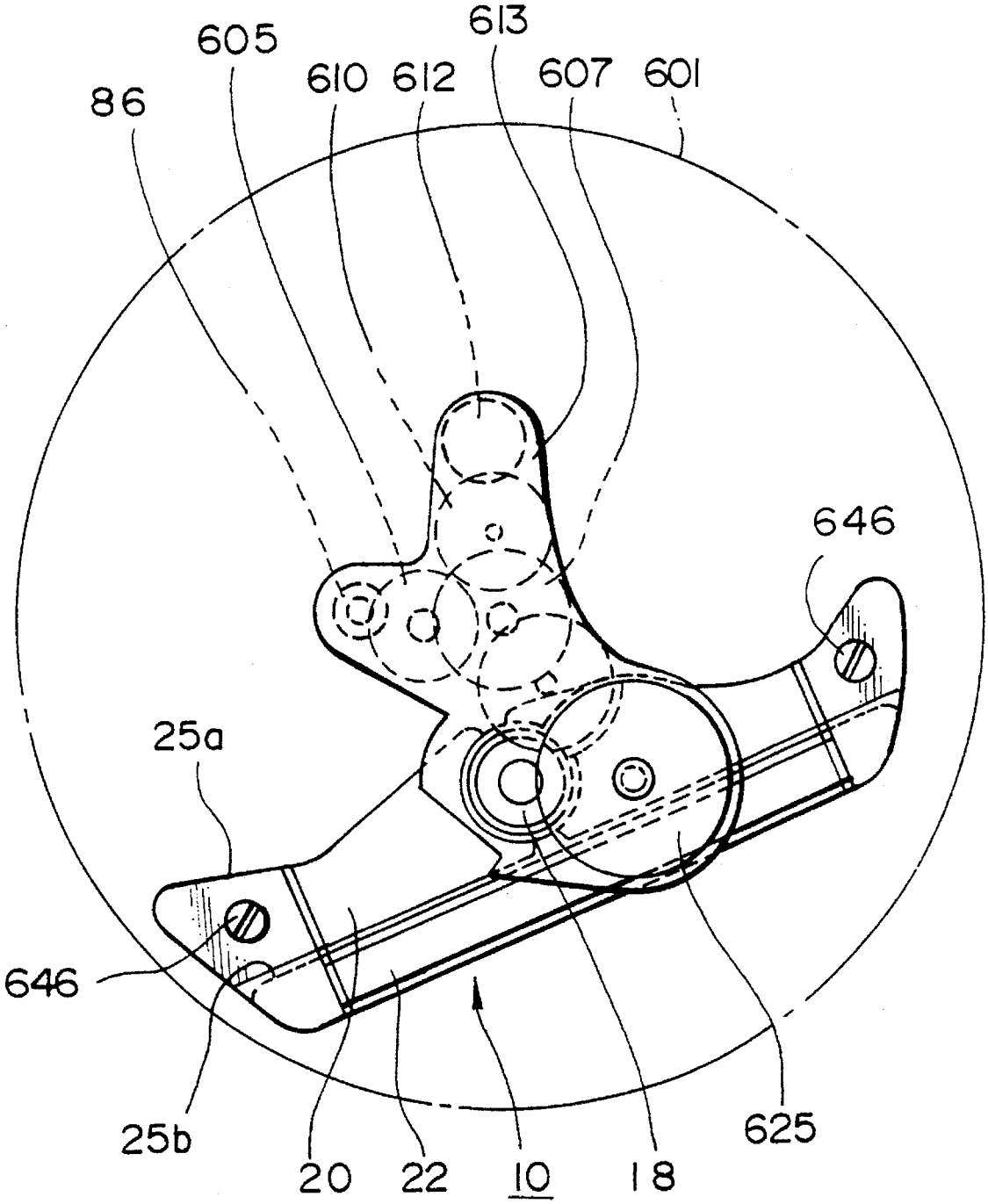
FIG. 18 illustrates the layout of the power generator and power generation gear train in the movement of FIG. 17.
Figure 19:
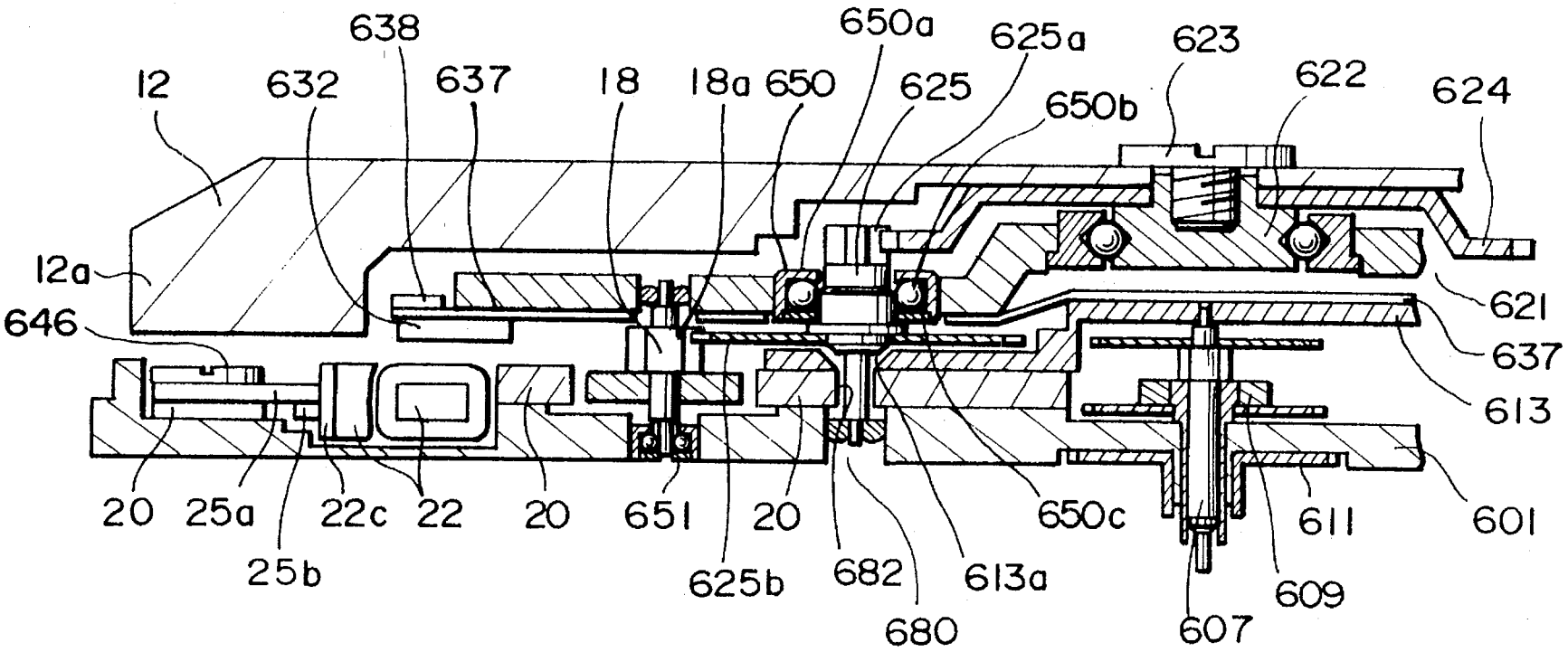
FIG. 19 is a schematic cross-section taken along a line B—B' in FIG. 17.
Figure 20:
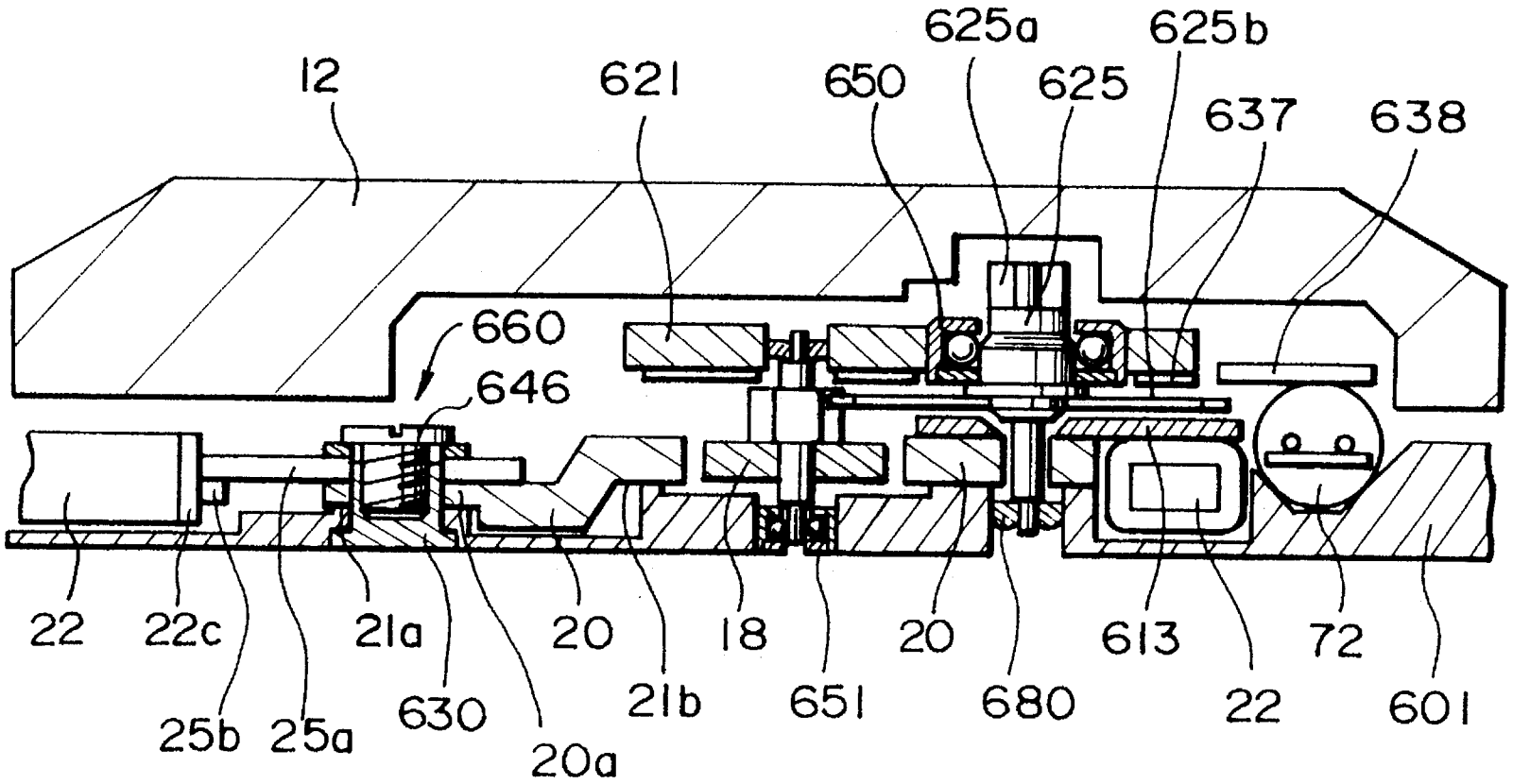
FIG. 20 is a schematic cross-section taken along a line C—C' in FIG. 17.

FIG. 17 schematically shows the movement of the electronic wrist watch according to the fourth embodiment as viewed from the side of the time indication window while FIG. 18 shows only the power generator 10 and gear train mechanism in the movement of FIG. 17. FIGS. 19 and 20 show the cross-sectional views of the movement of FIG. 17 taken along lines B—B' and C—C', respectively.

As shown in FIG. 17, the electronic wrist watch of the fourth embodiment comprises the power generator 10 and a drive step-motor 80 which are disposed on a plate 601 of the movement.

Figure 22:
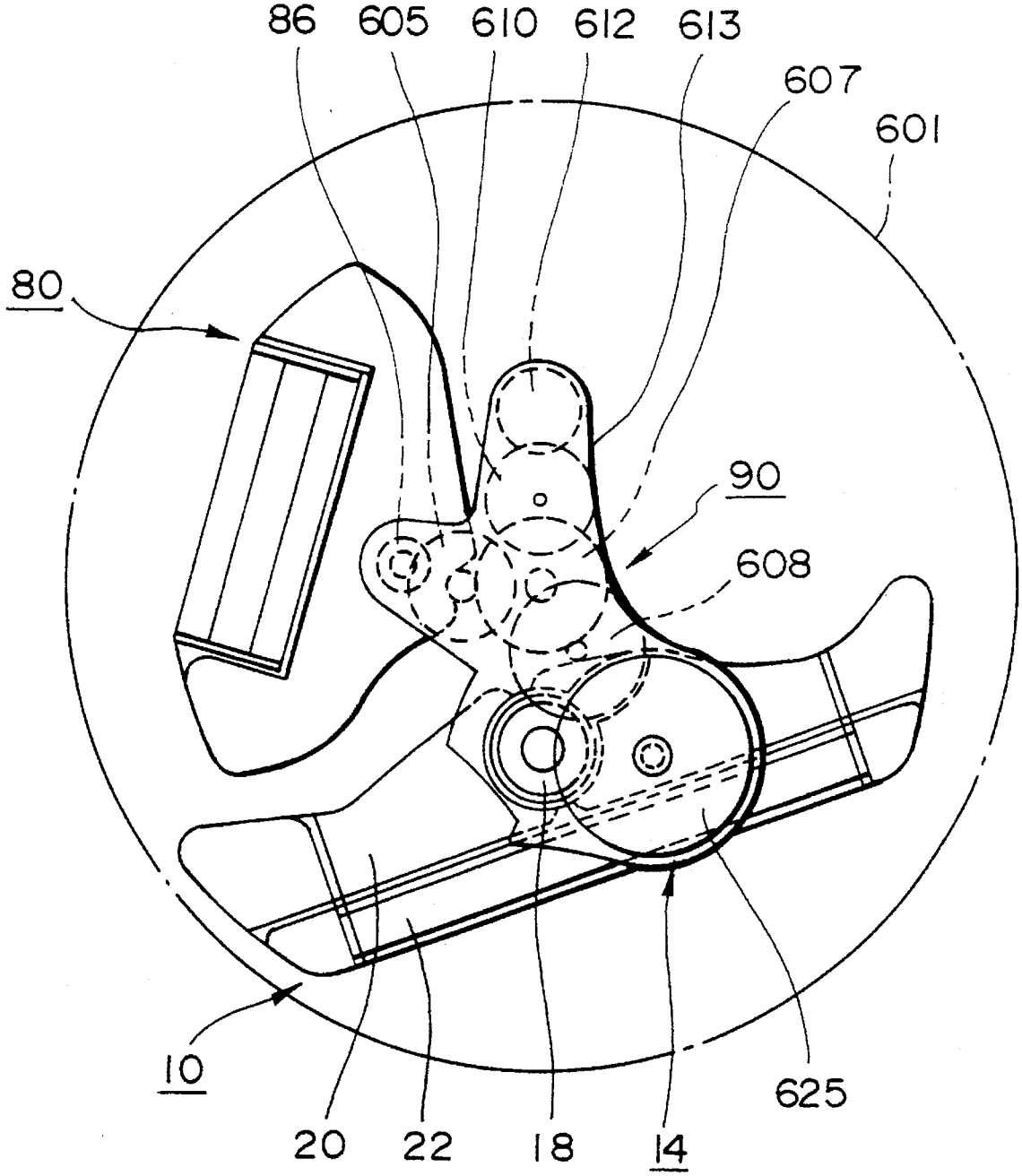
FIG. 22 illustrates the positional relationship between the drive step-motor and the drive gear train mechanism.

FIG. 22 schematically shows the drive step-motor 80 and a drive gear train mechanism 90 which are disposed on the movement. As will be apparent from FIG. 22, the rotation of a rotor 86 in the drive step-motor 80 is transmitted to a sweep second wheel and pinion 607, third wheel and pinion 608, center wheel and pinion 609, minute wheel 610 and hour wheel 611 through a fifth wheel and pinion 605. The minute wheel 610 engages with a setting wheel 612. (The wheels 609 and 610 are shown in FIG. 19).

In such a manner, the rotation of the step-motor 80 is transmitted to time indicating hands 104, 106 and 108. The drive gear train mechanism 90 is supported by a train wheel bridge 613. FIG. 19 shows part of the cross-section of the train wheel bridge 613 which is shown to support the gear train 607, 611 and 609.

A mechanism for transmitting the rotation of the oscillating weight 12 to the power generator 10 will be described.

Figure 21:
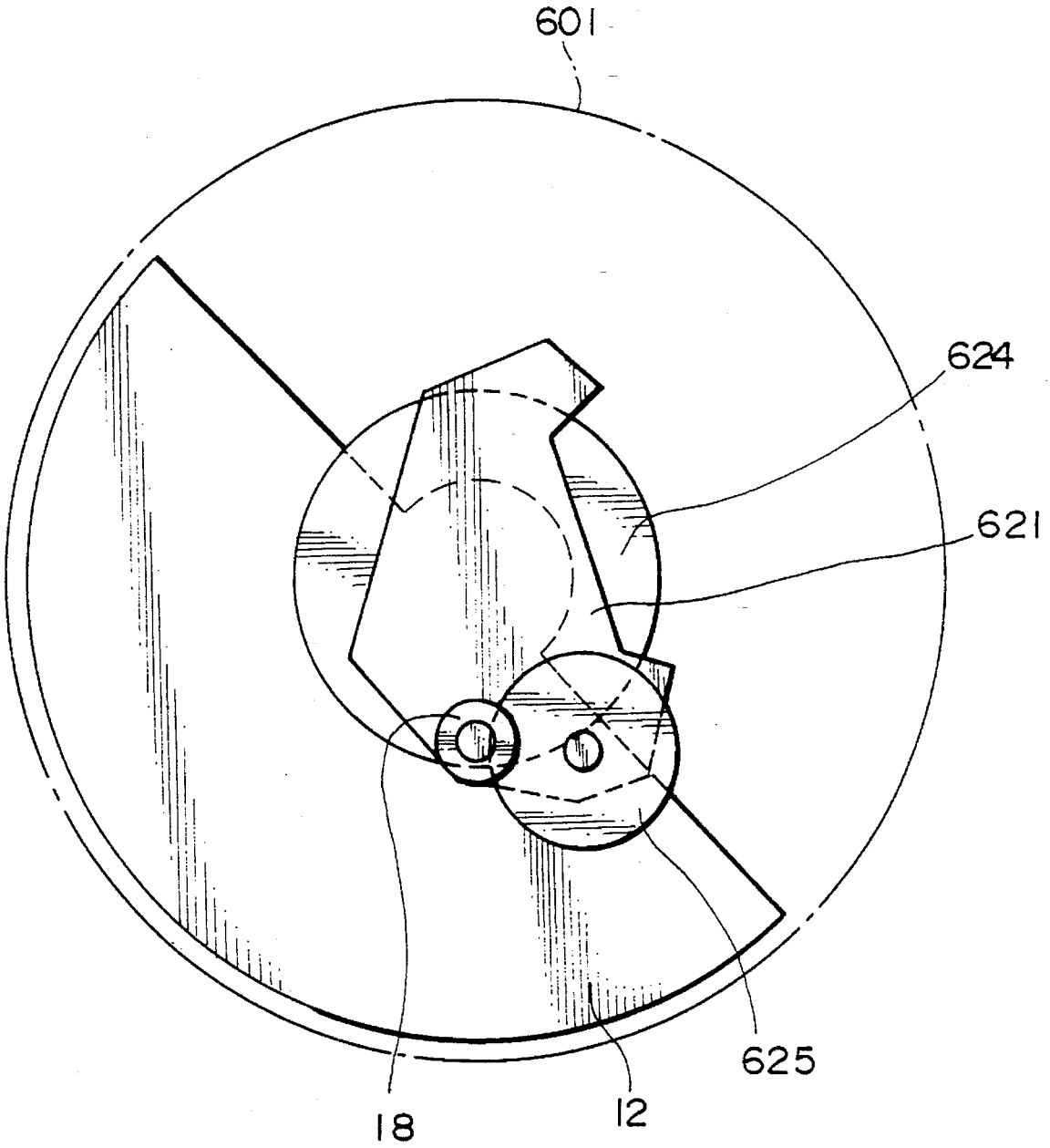
FIG. 21 is a schematic plan view illustrating the relationship between the oscillating weight, oscillating weight bridge and power generation gear train.

FIG. 19 schematically shows the cross-section of FIG. 17 taken along the line B—B' while FIG. 21 shows a schematic plan view of a rotation transmission mechanism 14 between the oscillating weight 12 and the power generator 10.

As shown in these figures, the oscillating weight 12 is rotatably mounted on a oscillating weight bridge 621 through a oscillating weight setscrew 623 and ball bearing 622.

An oscillating weight gear train 624 is integrally fixed to the lower part of the oscillating weight 12. The oscillating weight gear train 624 engages with a pinion **625*a* in an AGS gear train 625. The AGS gear train 625 includes a gear 625*b* engaged with a pinion 18*a* in the power generation rotor 18 to transmit the rotation of the oscillating weight 12 to the rotor 18. The gear train mechanism 14 from the oscillating weight gear train 624 to the power generation rotor 18 increase the rotational speed about 30 times to 200 times. Thus, the power generation rotor 18 will be rotated at a high speed by the rotation of the oscillating weight 12. The speed-increasing ratio depends on the performance of the power generator 10** or the specification of the timepiece.

The main feature of the fourth embodiment resides in that the power generation gear train mechanism 14 includes a train wheel bridge 613 located between the AGS gear train 625 on the backside of the oscillating weight bridge 621 and the plate 601.

The train wheel bridge 613 includes a shaft receiving aperture **613*a* formed therethrough. One end of the rotating shaft in the AGS gear train 625 extends through the shaft receiving aperture 613*a* and supported in a bearing 680 in the plate 601. The other end of the rotating shaft is supported by a bearing 650 in the oscillating weight bridge 621. The train wheel bridge 613 is disposed to provide a sufficient clearance to maintain it spaced away from the gear 625*b* of the AGS gear train 625**.

In such an arrangement, the undesirable skewing in the AGS gear train 625 can be avoided by the shaft receiving aperture **613*a* in the train wheel bridge 613. Furthermore, the oscillating weight bridge 621 supporting the upper shaft portion of the AGS gear train 625** can be more easily and effectively assembled into the electronic timepiece.

As shown in FIGS. 18 and 20, The train wheel bridge 613 is located between the power generation coil 22 of the power generator 10 and the gear **625*b* of the AGS gear train 625. Thus, the undesirable skewing can be avoided in the AGS gear train 625, as mentioned. In addition, the gear 625*a* of the AGS gear train 625 can be held into non-contact with the power generation coil 22**. This prevents the coil from being disconnected.

As shown in FIG. 19, the lower shaft portion of the AGS gear train 625 is formed to extend through not only the train wheel bridge 613, but also a shaft receiving aperture 682 formed in the power generation stator 20. It is preferred that the shaft receiving aperture 682 of the power generation stator 20 is formed as small as possible. This is because the power generation stator 20 forms a magnetic circuit for the power generator 10 with the rotor and power generation coil 18, 22. The amount of the magnetic flux passing through the power generation coil 22 depends on the amount of the minimum saturated magnetic flux in the cross-section of the magnetic circuit. To permit the low-resistant passage of the magnetic flux without obstruction, the cross-sectional area of the magnetic circuit should be sufficiently large. It is thus preferred that the shaft receiving aperture 682 of the power generation stator 20 is as small as possible.

For such a reason, in the fourth embodiment, the shaft receiving aperture 682 in the power generation stator 20 is formed to have a diameter substantially equal to that of the shaft receiving aperture **613*a* of the train wheel bridge 613. However, this raises a problem in that it becomes more difficult to insert the rotating shaft of the AGS gear train 625 into the shaft receiving apertures 613*a* and 682 in the train wheel bridge and stator 613, 20. To overcome such a problem, the fourth embodiment includes a tapered portion formed on the top of the shaft receiving aperture 613*a* in the train wheel bridge 613** and functioning as a assembly guide for improving the assembling property.

Various parts forming the power generator 10 will be described in connection with their layout.

In the fourth embodiment, the opening of the train wheel bridge 613 into which the power generation rotor 18 is to be assembled has a diameter larger than the maximum outer diameter of the rotor 18. Thus, the train wheel bridge 613, the power generation rotor 18 and the AGS gear train 625 can be assembled into the movement in such an order as described.

As be well-known in the art, the power generation rotor 18 includes a permanent magnet. As the rotor 18 is rotated, therefore, magnetic fluxes flow through the power generation coil 22 in different directions through the stator 20 to produce an induction voltage in the coil. The output power of the power generation coil 22 is provided to a circuit formed on the circuit board 637 through a coil lead board provided at the end of the power generation coil 22 and applied leads of the coil 22 (not shown).

As shown in FIGS. 18 and 20, in the power generator 10 of the fourth embodiment, the magnetic core 25 of the coil 22 is pressed against the stator 20 by a set-screw 646 to form a magnetic circuit.

The fourth embodiment improves the structure of the stator 20 to reduce the thickness of the electronic timepiece. As shown in FIG. 20, the stator 20 extending from the rotor side in the leftward direction as viewed in FIG. 20 is once bent toward the plate 601 and again bent to be parallel to the plate 601 at a position adjacent to a fixing portion 660 fixing the magnetic core 25. On the side of the fixing portion 660, a contact surface 21*a* of the stator 20 contacting the plate 601 is rolled to reduce the wall-thickness thereof into about one-half of the normal wall-thickness.

This thin-walled portion 20*a* is formed so that the contact surface 21*a* contacting the plate 601 is substantially 20 flush with or lower than an underside surface 21*b* of the stator 20 adjacent to the rotor. Thus, the thickness of the electronic timepiece can be reduced.

It is preferred that a rotating member such as power generation rotor 18 subjected to the lateral pressure during rotation is supported by bearing structures such as ball bearings 651 or the like. However, the ball bearings 651 have the increased number of parts and size, in comparison with jewels. If the ball bearings 651 are mounted in the plate 601 for supporting the rotor, it cannot be avoided to increase the wall-thickness of the plate 601 at that area. However, the wall-thickness of the plate 601 can be reduced since the fixing portion 660 between the stator 20 and the magnetic core 25 does not require such a thing. In other words, the movement can be reduced in wall-thickness by forming the portion of the plate 601 adjacent to the fixing portion 660 into a necessary and minimum wall-thickness which is required to hold a tube for a setscrew 630 for firmly holding the stator and magnetic core 20, 25. Therefore, the movement can more effectively be reduced in wall-thickness by bending the stator 20 toward the plate 601 on the side of the fixing portion 660, as described.

When the wall-thickness of the plate 601 is made to be larger at the functionally necessary parts, but smaller at the other parts, particularly, the entire wall-thickness of the plate 601 can be reduced with a more effective layout of parts.

The end of the stator 20 is formed with the thin-walled portion 20*a* and the contact surface 21*a* contacting the plate 601 is rolled. Therefore, a contact surface between the stator 20 and the magnetic core 25 less tends to produce a distortion, skew and/or irregularity. This can provide a stable magnetic connection.

The structures of the magnetic core 25 and power generation coil 22 will be described.

In the fourth embodiment, the magnetic core 25 is of a double-layer structure including magnetic core layers 25*a* and 25*b* of different configurations, as shown in FIG. 18. The magnetic core layer 25*a* is formed to bridge between a pair of set-screws 646. The other magnetic core layer 25*b* is formed to extend outwardly beyond the opposite ends of the power generation coil 22. Parts of the magnetic cores 25*a* and 25*b* within the power generation coil 22 are of the same configuration.

Such a double-layer structure of the magnetic core 25 can reduce an eddy current which is proportional to a square of the wall-thickness of the magnetic core to improve the performance of power generation. By forming the magnetic core 25 to contact the stator 20 only at the magnetic core layers 25*a*, the thickness of the movement can be reduced. The portion of the magnetic core 25*a* contacting the stator 20 can be reduced in thickness without pressing so that the contact surface can be formed more smoothly with a stable magnetic conduction.

The magnetic core 25 may be formed by three or more layers.

The magnetic core layer 25*a* is in contact with a thick-walled portion of the stator 20 in addition to the thin-walled portion 20*a* of the same. Since the magnetic core layer 25*a* is also in contact with the thick-walled portion of the stator 20 in such a manner, the magnetic resistance and leakage flux at the contact area between the magnetic core 25 and the stator 20 can be reduced to improve the performance of the power generator 10.

In the fourth embodiment, only the magnetic core 25*a* decides the position of the coil in the longitudinal direction. When the magnetic core 25 is of double-layer structure, dislocation is produced by tolerances in the parts and tools when the magnetic core layers are applied on each other. Such dislocation may shift the coil 22 in, the longitudinal direction to reduce the winding length of the coil. This may lower the performance of the coil. To overcome such a problem, only magnetic core layer 25*a* is used to decide the position of the coil 22. Thus, the coil can be wound to provide a stable performance of power generation without affection of the dislocation when the core layers are applied on each other. In the fourth embodiment, further, the opposite ends of the coil 22 may include a pair of coil frames for preventing a disturbance on winding the coil. The coil frame pair is mounted on the magnetic core 25*a* at invariable positions. Thus, the coil can be wound in a stable manner.

The circuit board 637 of the movement will be described.

As shown in FIGS. 19 and 20, a quartz oscillator 72, MOSIC chip 632, auxiliary capacitor 42, rectifying diode 30, voltage increasing capacitor 635 and other elements are mounted on the flexible circuit board 637 in the fourth embodiment. The circuit board 637 is pressed downwardly by a circuit holding plate 638 having a spring and fixed by screws.

In the fourth embodiment, the power generation parts including the power generation rotor 18, AGS gear train 625, stator 20 and power generation coil 22 are disposed on the circuit board 637 on the side of the plate 601. By disposing the electric parts of the power generator 10 and the electric circuit board 637 three-dimensionally, rather than two-dimensionally, the three-dimensional space can effectively be used to form the circuit board 637 into a sufficient size. As a result, the circuit pattern and layout of the electric elements can be freely made.

In FIGS. 17–22, 614 denotes a winding stem which is controlled by a setting lever 615. The setting lever 615 engages with a groove of the winding stem 614, with the position of the setting lever 615 being regulated by a yoke 616. The yoke 616 engages with a groove of a clutch wheel 617 which is guided by the winding stem 614. The movement includes a regulating lever (not shown) which is interlocked by the motion of the winding stem 614 to regulate the gear train and to reset the circuit. The setting lever and yoke 615, 616 are regulated relating to their up and down motions through a setting lever holder 618 which is fixed by a set-screw 645.

The outer periphery of the oscillating weight 12 has a thick-walled portion 12*a* which moves along a locus rotating outside almost all the internal parts forming the movement. At least part of the power generation coil 22 is disposed under the thick-walled portion 12*a*. The winding portion of the power generation coil 22 is disposed to locate under the gear 625*b* of the AGS gear train 625. Part of the power generation coil 22 is disposed to locate under the MOSIC chip 632 and circuit board 637.

As shown in FIG. 19, the AGS gear train 625 forming part of the power generation gear train 14 includes an upper mortise which is guided by a ball bearing 650 fixed to the oscillating weight bridge 621.

The ball bearing 650 includes an outer ring 650*a* fixed to the oscillating weight bridge 621 and a plurality of balls 650*b* engaging directly with the upper mortise of the AGS gear train 625. The upper part of the AGS gear train 625 is decided by a hold ring 650*c* fixed to the outer ring 650*a*. The outer ring 650*a* is made of non-magnetic material because in order to reduce magnetic effect on the power generator 10. If the magnetic effect can be ignored, the outer ring 650*a* may be made of magnetic material such as steel or the like. If the magnetic effect is too large, the parts other than the outer ring may be formed of non-magnetic material.

A bearing 651 is provided on the side of the lower mortise of the power generation rotor 18. The material of the bearing 651 also must be selected from magnetic and non-magnetic materials. Since the rotor 18 uses the permanent magnet located adjacent the bearing 651, it is desirable that at least the outer ring of the bearing 651 is made of non-magnetic material. The bearing 651 consists of an outer ring, balls and a hold ring. The outer ring determines the loosener in the power generation rotor 18.

The bearings 650 and 651 are intended to eliminate a retainer for reducing the size and manufacturing cost thereof. However, a retainer may be used in these bearings. In the bearing 650, the portion of the outer ring 650*a* adjacent to the hole extends toward the balls 650*b* to form a clearance between the outer ring 650*a* and the hold ring 650*c* that is smaller than the external diameter of the balls 650*b*. Thus, the balls 650*b* will not fall out even before the AGS gear train 625 is assembled into the movement. Since the balls can deviate to some extent before the AGS gear train 625 is assembled into the movement, a clearance is formed between the balls and the outer ring 650*a*. Such a clearance facilitates cleaning. The bearing 651 also includes its outer and hold rings having holes formed therethrough each of which has a diameter smaller than the external diameter of the balls. Thus, the balls will not fall out with the same advantages as mentioned above.

The fourth embodiment uses the bearings for supporting the upper portion of the AGS gear train 625 and the lower portion of the power generation rotor 18, for the following reasons. Since the AGS gear train 625 has its pinion 625*a* located above the oscillating weight bridge 621 for engaging with the oscillating weight gear train 624. To provide a general structure in which the AGS gear train 625 is supported by the oscillating weight bridge 621 and the plate 601 at the upper and lower portions of the AGS gear train 625, therefore, the internal diameter of the bearing must be larger than the external diameter of the pinion. This increases a load on the shaft. Since the power generation rotor 18 and associated permanent magnet are magnetically attracted to the power generation stator 20 by a magnetic force which is exerted to the lower mortise of the power generation rotor 18, the load is further increased. If the bearings are used in these areas, the load on the shaft can be reduced to improve the efficiency of power generation. If similar bearings are also used in the lower portion of the AGS gear train and the upper portion of the power generation rotor, the efficiency of power generation is further improved.

In such an arrangement, the electronic timepiece of the fourth embodiment can accomplish the reduced size and wall-thickness of the movement.

We claim:

1. An analog indication type electronic timepiece comprising:

power generation means for transforming kinetic energy produced by motions of a user into electric energy and for causing the electric energy to output from a power generation coil as electric charging energy;

a secondary power source charged with said electric charging energy;

anti-overcharging means which forms a bypass circuit for causing said electric charging energy to bypass said secondary power source when voltage of said secondary power source reaches a predetermined level, thereby preventing overcharging to the secondary power source;

a timepiece circuit driven by charged energy of said secondary power source to output motor drive pulses;

a drive motor including a drive coil and a drive rotor which is rotatably driven when the drive coil is energized by said motor drive pulses; and current limiting means for forcedly limiting bypass current flowing through said bypass circuit when the motor drive pulses are being output from said timepiece circuit.

2. The analog indication type electronic timepiece as defined in claim 1 wherein said current limiting means is in the form of forced breaking means for forcedly breaking off the bypass circuit in said anti-overcharging means as said motor drive pulses are output from said timepiece circuit.

3. The analog indication type electronic timepiece as defined in claim 1 wherein said power generation means comprises:

an oscillating weight which is rotatably mounted and transforms kinetic energy produced by motions of the user into rotational motion; and a power generator including a power generation rotor rotatably driven by said rotational motion, said power generator being operative to cause said electric charging energy to output from said power generation coil as a charging voltage by the rotation of said power generation rotor.

4. The analog indication type electronic timepiece as defined in claim 2 wherein said anti-overcharging means comprises switch means for ON/OFF controlling a short circuit in said secondary power source and wherein said forced breaking means is operative to detect output timing for said motor drive pulses for forcedly turning said switch means off as the motor drive pulses are being output.

5. The analog indication type electronic timepiece as defined in claim 4 wherein said forced breaking means is operative to detect when the overcharging to the secondary power source is avoided by said anti-overcharging means and to forcedly break said bypass circuit in said anti-overcharging means prior to output of the motor drive pulses, said bypass circuit being reconnected after the output of motor drive pulses have been terminated.

6. The analog indication type electronic timepiece as defined in claim 1 being formed as a wrist watch.

7. A method of charging a secondary power source of an analog indication type electronic timepiece, wherein said secondary power source is a drive power source of a timepiece circuit for outputting motor drive pulses toward a drive coil of a drive motor, said method comprising the steps of:

transforming kinetic energy produced by motions of a user into electric energy which is output as an electric charging energy from a power generation coil to charge said secondary power source;

forming a bypass circuit for causing said electric charging energy to bypass said secondary power source to prevent the overcharging to the secondary power source when voltage of said secondary power source reaches a predetermined level; and forcedly limiting bypass current flowing through said bypass circuit when the motor drive pulses are being output from said timepiece circuit.

8. An analog indication type electronic timepiece comprising:

power generation means for transforming kinetic energy produced by motions of a user into electric energy and for causing the electric energy to output from a power generation coil as electric-charging energy;

a secondary power source charged with said electric charging energy;

anti-overcharging means which forms a bypass circuit for causing said electric charging energy to bypass said secondary power source when voltage of said secondary power source reaches a predetermined level, thereby preventing overcharging to the secondary power source;

a timepiece circuit driven by charged energy of said secondary power source to output motor drive pulses; and a drive motor including a drive coil and a drive rotor which is rotatably driven when the drive coil is energized by said motor drive pulses, said timepiece circuit being operative to output a motor drive pulse containing, in its latter half, an anti-reverse area for preventing reverse rotation of said drive rotor.

9. The analog indication type electronic timepiece as defined in claim 8 wherein said timepiece circuit detects anti-overcharging operation for said secondary power source and outputs said motor drive pulse containing, at its latter half, said anti-reverse area for preventing reverse rotation of the drive rotor when said anti-overcharging operation is detected.

10. The analog indication type electronic timepiece as defined in claim 8 wherein said timepiece circuit outputs said anti-reverse area consisting of intermittent pulses.

11. The analog indication type electronic timepiece as defined in claim 9 wherein said timepiece circuit outputs said anti-reverse area consisting of intermittent pulses.

12. The analog indication type electronic timepiece as defined in claim 8 wherein said power generation means comprises an oscillating weight which is rotatably mounted and transforms kinetic energy produced by motions of the user into rotational motion and a power generator including a power generation rotor rotatably driven by said rotational motion, said power generator being operative to cause said electric charging energy to output from said power generation coil as a charging voltage by the rotation of said power generation rotor.

13. An analog indication type electronic timepiece comprising:

power generation means for transforming kinetic energy produced by motions of a user into electric energy and for causing the electric energy to output from a power generation coil as electric charging energy;

a secondary power source charged with said electric charging energy;

anti-overcharging means which forms a bypass circuit for causing said electric charging energy to bypass said secondary power source when voltage of said secondary power source reaches a predetermined level, thereby preventing overcharging to the secondary power source;

a timepiece circuit driven by charged energy of said secondary power source to output motor drive pulses; and a drive motor including a drive coil and a drive rotor which is rotatably driven when the drive coil is energized by said motor drive pulses, whereby voltage level of said motor drive pulses lowered down to a level equal to or lower than a return malfunction area of said drive motor when the overcharging to said secondary power source is being prevented.

14. The analog indication type electronic timepiece as defined in claim 13 wherein said secondary power source comprises:

a secondary cell to be charged by said electric charging energy;

a voltage increasing circuit for increasing voltage of said secondary cell; and an auxiliary cell to be charged by output voltage of said voltage increasing circuit, said voltage increasing circuit being operative to reduce the voltage increasing level such that voltage level of said motor drive pulses will be equal to or lower than said return malfunction area when the overcharging to said secondary power source is being prevented.

15. The analog indication type electronic timepiece as defined in claim 13 wherein said timepiece circuit is formed to reduce voltage level of said motor drive pulses to a level equal to or lower than said return malfunction area when the overcharging to said secondary power source is being prevented.

16. A method of charging a secondary power source of an analog indication type electronic timepiece, wherein said secondary power source is a drive power source of a timepiece circuit for outputting motor drive pulses toward a drive coil of a drive motor, said method comprising the steps of:

transforming kinetic energy produced by motions of a user into electric energy which is output as an electric energy from a power generation coil to charge said secondary power source;

forming a bypass circuit for causing said electric charging energy to bypass said secondary power source to prevent the overcharging to the secondary power source when voltage of said secondary power source reaches a predetermined level; and outputting a motor drive pulses each containing, in its latter half, an anti-reverse area for preventing reverse rotation of said drive rotor when said bypass circuit is formed.

17. A method of charging a secondary power source of an analog indication type electronic timepiece, wherein said secondary power source is a drive power source of a timepiece circuit for outputting motor drive pulses toward a drive coil of a drive motor, said method comprising the steps of:

transforming kinetic energy produced by motions of a user into electric energy which is output as an electric energy from a power generation coil to charge said secondary power source;

forming a bypass circuit for causing said electric charging energy to bypass said secondary power source to prevent the overcharging to the secondary power source when voltage of said secondary power Source reaches a predetermined level; and outputting a motor drive pulse having its voltage level equal to or lower than a return malfunction area of said drive motor when said bypass circuit is formed.

18. The analog indication type electronic timepiece as defined in claim 1, further comprising:

a housing;

a movement disposed within said housing; and a ring-shaped inside frame located between said housing and said movement for preventing an undesirable play in said movement, said inside frame including an empty portion to insert an external operation unit into the interior of said housing and a bridge portion bridging said empty portion, an oscillating weight of said means eccentrically and rotatably mounted on said movement on the opposite side of said empty portion.

19. The analog indication type electronic timepiece as defined in claim 18 wherein the eccentricity of said oscillating weight is substantially equal to half of the extension of said bridge portion toward the oscillating weight plus half of the gap between said bridge portion and said oscillating weight.

20. The analog indication type electronic timepiece as defined in claim 18 wherein the eccentricity of said oscillating weight is substantially equal to half of the extension of the external operation unit into the inside frame through said empty portion plus half of the gap between the extension of said external operation unit and said oscillating weight.

21. The analog indication type electronic timepiece as defined in claim 18 wherein said bridge portion is formed on an inner periphery of said inside frame as a ring-shaped shock absorbing member having its inner periphery which is located on a circle concentric to a rotational locus of said oscillating weight and wherein when an impact is received, the inner periphery of said shock absorbing member protects said oscillating weight.

22. The analog indication type electronic timepiece as defined in claim 21 wherein a part of said ring-shaped shock absorbing member on the side opposite to said empty portion is cut out by a length within the outer periphery of said oscillating weight.

23. The analog indication type electronic timepiece as defined in claim 1, further comprising:

a drive gear train mechanism for transmitting the rotational output of said drive motor to an indication portion; and a drive train wheel bridge for supporting said drive gear train mechanism, said power generation means including:

a oscillating weight rotatably mounted on a oscillating weight bridge for transforming kinetic energy produced by motions of the user into rotational motion;

a power generator including a power generation rotor rotatably driven by said rotational motion, said power generator being operative to cause said electric charging energy to output from said power generation coil as a charging voltage by the rotation of said power generation rotor; and a power generation gear train mechanism for transmitting the rotation motion of said oscillating weight to said power generation rotor, said power generator including a power generation stator for flowing magnetic flux from said power generation rotor into the power generation coil, said power generation stator forming a magnetic circuit with said power generation rotor and coil, said power generator being operative to cause the electric charging energy to output from said power generation coil as a charging voltage by the rotation of said power generation rotor, said train wheel bridge being disposed between at least part of a first power generation gear train in said power generation gear train mechanism located on the side opposite to the support surface of said oscillating weight bridge and a bearing located opposite to the oscillating weight in said first power generation gear train, said train wheel bridge including an aperture formed therethrough for receiving one end of rotating shaft of said first power generation gear train.

24. The analog indication type electronic timepiece as defined in claim 23 wherein said first power generation gear train is formed so that one end of its shaft portion will pass through an aperture formed through said power generation stator.

25. The analog display type electronic timepiece as defined in claim 24 wherein said power generation stator preferably has its aperture formed therethrough to have a diameter substantially equal to that of the aperture formed through said train wheel bridge.

26. The analog indication type electronic timepiece as defined in claim 25 wherein said train wheel bridge includes an aperture formed therethrough to have its tapered periphery for guiding rotary shaft.

27. The analog indication type electronic timepiece as defined in claim 23 wherein said train wheel bridge is located between said power generation coil and said power generation gear train to prevent a contact between said power generation gear train and said power generation coil.

28. The analog indication type electronic timepiece as defined in claim 23 wherein a magnetic core of said power generator is of a multi-layered structure including magnetic layers of different shapes.

29. The analog indication type electronic timepiece as defined in claim 28 wherein one magnetic core of said magnetic cores of multi-layered structure on the side of said oscillating weight is superimposed on and connected to the power generation stator in a direction of thickness of the timepiece to form said magnetic circuit.

30. The analog indication type electronic timepiece as defined in claim 28 wherein said magnetic cores of multi-layered structure have the same shape of core layers in at east coil winding portion.

31. The analog indication type electronic timepiece as defined in claim 30 wherein said power generator includes coil frames on the opposite ends of the power generation coil for preventing a disturbance in coil windings and wherein the position of each of said coil frames is defined by a magnetic core layer in multi-layered structure, the entire length of said power generation coil being invariable.

32. The analog indication type electronic timepiece as defined in claim 23, further comprising a holding member in which said bearing of said first power generation gear train is formed, the position of the contact surface between said power generation stator and said holding member being located closer to the holding member than a surface of said power generation stator on the side of said holding member adjacent to said power generation rotor.

33. The analog indication type electronic timepiece as defined in claim 23 wherein a movement circuit board is located between said first power generation gear train and said oscillating weight.

* * * * *